US007959252B2

(12) United States Patent
Endo

(10) Patent No.: US 7,959,252 B2
(45) Date of Patent: Jun. 14, 2011

(54) METHOD FOR FORMING EJECTION-TEST PATTERN, METHOD FOR TESTING EJECTION, PRINTING APPARATUS, COMPUTER-READABLE MEDIUM, AND PRINTING SYSTEM

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/035,375

(22) Filed: Feb. 21, 2008

(65) Prior Publication Data

US 2008/0150980 A1 Jun. 26, 2008

Related U.S. Application Data

(62) Division of application No. 10/890,484, filed on Jul. 14, 2004, now Pat. No. 7,354,127.

(30) Foreign Application Priority Data

Jul. 16, 2003 (JP) ..... 2003-197915
Jul. 16, 2003 (JP) ..... 2003-197916

(51) Int. Cl.
*B41J 29/393* (2006.01)

(52) U.S. Cl. ..... 347/19; 347/14; 347/98
(58) Field of Classification Search ..... 347/19
See application file for complete search history.

(56) References Cited

U.S. PATENT DOCUMENTS 5,898,443 A * 4/1999 Yoshino et al. ..... 347/19
6,312,082 B1 11/2001 Lund et al.
6,454,383 B2 9/2002 Lund et al.
6,572,213 B2 6/2003 Valero
6,644,772 B2 11/2003 Choi

FOREIGN PATENT DOCUMENTS

JP 11-240191 A 9/1999
JP 2001-063031 A 3/2001
JP 2003-159783 A 6/2003

* cited by examiner

*Primary Examiner* — Matthew Luu
*Assistant Examiner* — Brian J Goldberg
(74) *Attorney, Agent, or Firm* — Sughrue Mion, PLLC

(57) ABSTRACT

Ejection of a clear-ink nozzle is inspected with ease. When forming an ejection-test pattern for a clear ink, for example, the clear ink is ejected toward a medium from a clear-ink nozzle to form the ejection-test pattern, and a color ink is ejected toward a region in which the clear ink is to adhere from at least two color-ink nozzles to form the ejection-test pattern.

14 Claims, 28 Drawing Sheets

METHOD FOR FORMING EJECTION-TEST PATTERN, METHOD FOR TESTING EJECTION, PRINTING APPARATUS, COMPUTER-READABLE MEDIUM, AND PRINTING SYSTEM

CROSS-REFERENCE TO RELATED APPLICATIONS

This is a divisional of application Ser. No. 10/890,484. Priority is claimed from Japanese Patent Application No. 2003-197915 filed on Jul. 16, 2003 and Japanese Patent Application No. 2003-197916 filed on Jul. 16, 2003. The entire disclosure of the prior application, application Ser. No. 10/890,484, and the above-identified priority documents, are herein incorporated by reference.

BACKGROUND OF THE INVENTION

1. Field of the Invention

The present invention relates to methods for forming ejection-test patterns, methods for testing ejection, printing apparatuses, computer-readable media, and printing systems.

2. Description of the Related Art

Inkjet printers are known as a type of printing apparatus that carries out printing by ejecting ink onto various media such as paper, cloth, and film. These inkjet printers perform color printing by ejecting color inks such as cyan (C), magenta (M), yellow (Y), and black (K) to form dots on the medium. Ink ejection is normally carried out using nozzles.

However, depending on such factors as firm fixing of the ink, a nozzle may sometimes become clogged and ink may not be properly ejected. When ink is not properly ejected from the nozzles, dots cannot be formed on the medium, and it is not possible to form a proper image. Therefore, it is necessary to test whether or not ink is being ejected properly by periodically testing nozzle ejection in order to find such nozzle ejection failure.

For this reason, it has been proposed that in serial-type printers such as inkjet printers, tests on whether or not there are defective dots are to be performed by actually carrying out printing on a recording paper (see JP 11-240191A). In this case, an image sensor is provided in the printer, and this image sensor is used to check whether or not there are defective dots by detecting the state of the printing. When there is a defective dot, the position of the defective dot is stored, and this dot is complemented during printing by using another nozzle, for example.

In recent years, printing apparatuses have been introduced in which a colorless transparent liquid called "clear ink" is ejected in addition to the color inks such as cyan (C), magenta (M), yellow (Y), and black (K). The clear ink ejected in such cases is a liquid that is ejected for the purpose of, for example, improving the quality of the printed image, and specifically, it plays: (1) the role of causing the ink to coagulate and promote fixation, (2) the role of improving the level of gloss, and (3) the role of forming a protective layer on the surface of the medium.

However, since such clear ink is colorless and transparent, it cannot be easily detected by a sensor or the like when ejected onto the medium, and for this reason, it is not possible to easily test ejection even when such ink is actually ejected onto the medium.

SUMMARY OF THE INVENTION

The present invention was achieved in light of the foregoing issues, and it is an object thereof to allow nozzles for ejecting clear ink to be effectively subjected to ejection testing.

An aspect of the present invention is a method for forming an ejection-test pattern as follows:

A method for forming an ejection-test pattern for a clear ink, comprises the steps of:

ejecting a clear ink toward a medium from a clear-ink nozzle to form the ejection-test pattern; and ejecting a color ink toward a region in which the clear ink is to adhere from at least two color-ink nozzles to form the ejection-test pattern.

Another aspect of the present invention is a method for testing ejection as follows:

A method for testing ejection of a clear ink, comprises the steps of:

ejecting a clear ink toward a medium from a clear-ink nozzle to form a ejection-test pattern;

ejecting a color ink toward a region in which the clear ink is to adhere from at least two color-ink nozzles to form the ejection-test pattern; and checking whether or not there is ejection failure in the clear-ink nozzle based on detection information from a sensor for detecting the ejection-test pattern that has been formed on the medium.

Another aspect of the present invention is a printing apparatus as follows:

A printing apparatus comprising:

a clear-ink nozzle for ejecting a clear ink;

a color-ink nozzle for ejecting a color ink; and a controller for controlling ejection of ink from the clear-ink nozzle and the color-ink nozzle;

wherein the controller causes the clear-ink nozzle to eject the clear ink toward a medium to form an ejection-test pattern for the clear ink; and causes at least two color-ink nozzles to eject the color ink toward a region in which the clear ink is to adhere to form the ejection-test pattern.

Another aspect of the present invention is a computer-readable medium as follows:

A computer-readable medium comprises:

a code for causing a clear-ink nozzle to eject a clear ink toward a medium to form an ejection-test pattern for the clear ink; and a code for causing at least two color-ink nozzles to eject a color ink toward a region in which the clear ink is to adhere to form the ejection-test pattern.

Another aspect of the present invention is a printing system as follows:

A printing system comprises:

a computer; and a printing apparatus that is connectable to the computer, the printing apparatus including:

a clear-ink nozzle for ejecting a clear ink;

a color-ink nozzle for ejecting a color ink; and a controller for controlling ejection of ink from the clear-ink nozzle and the color-ink nozzle;

wherein the controller causes the clear-ink nozzle to eject the clear ink toward a medium to form an ejection-test pattern for the clear ink; and causes at least two color-ink nozzles to eject the color ink toward a region in which the clear ink is to adhere to form the ejection-test pattern.

Another aspect of the present invention is a method for forming an ejection-test pattern as follows:

A method for forming an ejection-test pattern, comprises the steps of:

forming, on a medium, a first test pattern that is used for inspecting ejection of a color-ink nozzle by ejecting a color ink from the color-ink nozzle;

inspecting the ejection of the color-ink nozzle using the first test pattern; and after inspecting the ejection of the color-ink nozzle, forming, on a medium, a second test pattern that is used for inspecting ejection of a clear-ink nozzle, the second test pattern being made using the color ink ejected from the color-ink nozzle and a clear ink ejected from the clear-ink nozzle.

Another aspect of the present invention is a method for testing ejection as follows:

A method for testing ejection, comprises the steps of:

forming, on a medium, a first test pattern that is used for inspecting ejection of a color-ink nozzle by ejecting a color ink from the color-ink nozzle;

inspecting the ejection of the color-ink nozzle using the first test pattern;

after inspecting the ejection of the color-ink nozzle, forming, on a medium, a second test pattern that is used for inspecting ejection of a clear-ink nozzle, the second test pattern being made using the color ink ejected from the color-ink nozzle and a clear ink ejected from the clear-ink nozzle; and inspecting the ejection of the clear-ink nozzle using the second test pattern.

Another aspect of the present invention is a printing apparatus as follows:

A printing apparatus comprises:

a clear-ink nozzle for ejecting a clear ink;

a color-ink nozzle for ejecting a color ink; and a controller for controlling ejection of ink from the clear-ink nozzle and the color-ink nozzle;

wherein the controller causes a first test pattern that is used for inspecting ejection of the color-ink nozzle to be formed on a medium by ejecting the color ink from the color-ink nozzle;

causes the ejection of the color-ink nozzle to be inspected using the first test pattern; and after inspecting the ejection of the color-ink nozzle, causes a second test pattern that is used for inspecting ejection of the clear-ink nozzle to be formed on a medium, the second test pattern being made using the color ink ejected from the color-ink nozzle and the clear ink ejected from the clear-ink nozzle.

Another aspect of the present invention is a computer-readable medium as follows:

A computer-readable medium comprises:

a code for causing a first test pattern that is used for inspecting ejection of a color-ink nozzle to be formed on a medium by ejecting a color ink from the color-ink nozzle;

a code for causing the ejection of the color-ink nozzle to be inspected using the first test pattern; and a code for causing a second test pattern that is used for inspecting ejection of a clear-ink nozzle to be formed on a medium after inspecting the ejection of the color-ink nozzle, the second test pattern being made using the color ink ejected from the color-ink nozzle and a clear ink ejected from the clear-ink nozzle.

Another aspect of the present invention is a printing system as follows:

A printing system comprises:

a computer; and a printing apparatus that is connectable to the computer, the printing apparatus including:

a clear-ink nozzle for ejecting a clear ink;

a color-ink nozzle for ejecting a color ink; and a controller for controlling ejection of ink from the clear-ink nozzle and the color-ink nozzle;

wherein the controller causes a first test pattern that is used for inspecting ejection of the color-ink nozzle to be formed on a medium by ejecting the color ink from the color-ink nozzle;

causes the ejection of the color-ink nozzle to be inspected using the first test pattern; and after inspecting the ejection of the color-ink nozzle, causes a second test pattern that is used for inspecting ejection of the clear-ink nozzle to be formed on a medium, the second test pattern being made using the color ink ejected from the color-ink nozzle and the clear ink ejected from the clear-ink nozzle.

Features of the present invention other than the above will become clear through the description below and the accompanying drawings.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF PREFERRED EMBODIMENTS

Figure 1:
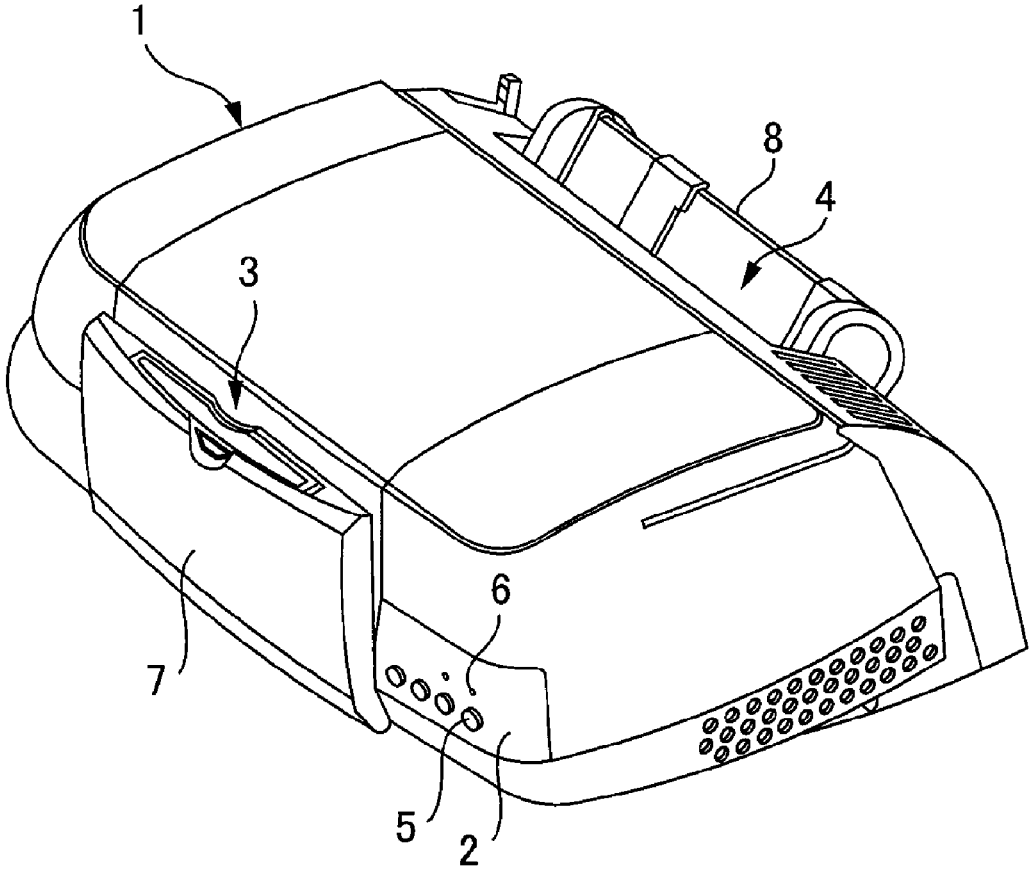
FIG. 1 is a perspective view of an inkjet printer.

At least the following matters will be made clear by the present specification and the accompanying drawings.

A method for forming an ejection-test pattern for a clear ink, comprises the steps of:

ejecting a clear ink toward a medium from a clear-ink nozzle to form the ejection-test pattern; and ejecting a color ink toward a region in which the clear ink is to adhere from at least two color-ink nozzles to form the ejection-test pattern.

According to such a method for forming an ejection-test pattern, the color ink is ejected from at least two color-ink nozzles toward a region in which the clear ink is to adhere, in order to form the ejection-test pattern. Therefore, even if there is ejection failure in the color-ink nozzle, it is possible to form a test pattern for the clear-ink nozzle by ejecting color ink from another color-ink nozzle.

In the above-mentioned method for forming an ejection-test pattern, there may be a plurality of the clear-ink nozzles; and the ejection-test pattern may include patterns for each of the clear-ink nozzles. In this way, it is possible to effectively form patterns for each clear-ink nozzle.

In the above-mentioned method for forming an ejection-test pattern, the color ink may be ejected toward the region in which the clear ink is to adhere from at least two color-ink nozzles after the clear ink is ejected from the clear-ink nozzle. In this way, it is possible to form patterns for each clear-ink nozzle more effectively.

In the above-mentioned method for forming an ejection-test pattern, the ejection-test pattern may be formed using one type of the color-ink nozzle of among a plurality of types of color-ink nozzles that respectively eject color inks of different colors. In this way, it is possible to satisfactorily form a test pattern for the clear-ink nozzle.

In the above-mentioned method for forming an ejection-test pattern, the ejection-test pattern may be formed using one type of the color-ink nozzle that ejects a color ink, among the color inks of different colors, other than a color ink of the lightest color. By using a color ink, among the color inks of different colors, other than that of the lightest color, it is possible to satisfactorily form a test pattern for the clear-ink nozzle.

In the above-mentioned method for forming an ejection-test pattern, the color ink and the clear ink may blur when the color ink adheres to a region in which the clear ink has adhered. By making the color ink and the clear ink blur in this way, it is possible to easily inspect the ejection of the clear-ink nozzle.

In the above-mentioned method for forming an ejection-test pattern, a darkness of the color of the color ink when the color ink adheres to a region in which the clear ink has adhered may be different from a darkness of the color of the color ink when the color ink adheres to a region in which the clear ink has not adhered. Further, a darkness of the color of the color ink when the color ink adheres to the region in which the clear ink has adhered may be darker than a darkness of the color of the color ink when the color ink adheres to the region in which the clear ink has not adhered. By making the darkness of the color different, or even making the color darker, in this way, it is possible to easily inspect the ejection of the clear-ink nozzle.

In the above-mentioned method for forming an ejection-test pattern, the color ink may be ejected from the color-ink nozzle also with respect to a region in which the clear ink should not be adhering. By ejecting the color ink also with respect to a region in which the clear ink should not be adhering, it becomes possible to easily determine whether or not the clear ink is being ejected properly.

In the above-mentioned method for forming an ejection-test pattern, an ejection-test pattern that is used for inspecting ejection of the color-ink nozzles may be formed on the medium. By allowing such a test pattern to be formed, it becomes possible to inspect the ejection of the color-ink nozzle.

In the above-mentioned method for forming an ejection-test pattern, the ejection-test pattern that is used for inspecting ejection of the color-ink nozzles may be formed on the same medium as the ejection-test pattern that is used for inspecting ejection of the clear-ink nozzle. By forming the two test patterns on the same medium, it is possible to reduce waste of media.

It is also possible to achieve a method for forming an ejection-test pattern for a clear ink as follows:

A method for forming an ejection-test pattern for a clear ink, comprises the steps of:

ejecting a clear ink toward a medium from a clear-ink nozzle to form the ejection-test pattern; and after the clear ink is ejected from the clear-ink nozzle, ejecting a color ink toward a region in which the clear ink is to adhere from at least two color-ink nozzles to form the ejection-test pattern;

wherein there are a plurality of the clear-ink nozzles;

wherein the ejection-test pattern includes patterns for each of the clear-ink nozzles;

wherein the ejection-test pattern is formed using one type of the color-ink nozzle that ejects a color ink, among color inks of different colors, other than a color ink of the lightest color;

wherein the color ink and the clear ink blur when the color ink adheres to a region in which the clear ink has adhered;

wherein a darkness of the color of the color ink when the color ink adheres to the region in which the clear ink has adhered is darker than a darkness of the color of the color ink when the color ink adheres to a region in which the clear ink has not adhered; and wherein the color ink is ejected from the color-ink nozzle also with respect to a region in which the clear ink should not be adhering.

It is also possible to achieve a method for testing ejection of a clear ink as follows:

A method for testing ejection of a clear ink, comprises the steps of:

ejecting a clear ink toward a medium from a clear-ink nozzle to form a ejection-test pattern;

ejecting a color ink toward a region in which the clear ink is to adhere from at least two color-ink nozzles to form the ejection-test pattern; and checking whether or not there is ejection failure in the clear-ink nozzle based on detection information from a sensor for detecting the ejection-test pattern that has been formed on the medium.

It is also possible to achieve a printing apparatus as follows:

A printing apparatus comprises:

a clear-ink nozzle for ejecting a clear ink;

a color-ink nozzle for ejecting a color ink; and a controller for controlling ejection of ink from the clear-ink nozzle and the color-ink nozzle;

wherein the controller causes the clear-ink nozzle to eject the clear ink toward a medium to form an ejection-test pattern for the clear ink; and causes at least two color-ink nozzles to eject the color ink toward a region in which the clear ink is to adhere to form the ejection-test pattern.

It is also possible to achieve a computer-readable medium as follows:

A computer-readable medium comprises:

a code for causing a clear-ink nozzle to eject a clear ink toward a medium to form an ejection-test pattern for the clear ink; and a code for causing at least two color-ink nozzles to eject a color ink toward a region in which the clear ink is to adhere to form the ejection-test pattern.

It is also possible to achieve a printing system as follows:

A printing system comprises:

a computer; and a printing apparatus that is connectable to the computer, the printing apparatus including:

a clear-ink nozzle for ejecting a clear ink;

a color-ink nozzle for ejecting a color ink; and a controller for controlling ejection of ink from the clear-ink nozzle and the color-ink nozzle;

wherein the controller causes the clear-ink nozzle to eject the clear ink toward a medium to form an ejection-test pattern for the clear ink; and causes at least two color-ink nozzles to eject the color ink toward a region in which the clear ink is to adhere to form the ejection-test pattern.

A method for forming an ejection-test pattern, comprises the steps of:

forming, on a medium, a first test pattern that is used for inspecting ejection of a color-ink nozzle by ejecting a color ink from the color-ink nozzle;

inspecting the ejection of the color-ink nozzle using the first test pattern; and after inspecting the ejection of the color-ink nozzle, forming, on a medium, a second test pattern that is used for inspecting ejection of a clear-ink nozzle, the second test pattern being made using the color ink ejected from the color-ink nozzle and a clear ink ejected from the clear-ink nozzle.

According to the above-mentioned method for forming an ejection-test pattern, by ejecting the color ink in an overlapping manner onto the region in which the clear ink is to adhere, the color of the section in which the two inks overlap becomes different from that of the other sections. Therefore, it is possible to easily determine whether or not the clear ink is being ejected properly. Further, the second test pattern that is used for inspecting the ejection of the clear-ink nozzle is formed after inspecting the ejection of the color-ink nozzle. Therefore, it is possible to certainly eject the color ink to the region in which the clear ink is to adhere. As a result, it is possible to prevent such problems as that the ejection of the clear ink cannot be inspected because the color ink cannot be ejected due to ejection failure in the color-ink nozzle, and therefore, it is possible to certainly inspect the ejection of the clear ink.

In such a method for forming an ejection-test pattern, the ejection of the color-ink nozzle may be inspected by detecting the first test pattern with a sensor. In this way, it is possible to effectively detect the first test pattern using a sensor.

In such a method for forming an ejection-test pattern, if it is recognized that there is ejection failure in the color-ink nozzle as a result of inspecting the ejection of the color-ink nozzle, then a cleaning process of the color-ink nozzle may be performed before forming the second test pattern. By performing such a cleaning process, it is possible to eliminate the ejection failure in the color-ink nozzle.

In such a method for forming an ejection-test pattern, the second test pattern may be formed after performing the cleaning process. By forming the second test pattern after eliminating the ejection failure in the color-ink nozzle, it is possible to form the color-ink pattern certainly.

In such a method for forming an ejection-test pattern, the first test pattern may be formed again and the ejection of the color-ink nozzle may be inspected based on the first test pattern after performing the cleaning process and before forming the second test pattern. By performing such a process, it is possible to eliminate the ejection failure in the color-ink nozzle more certainly.

In such a method for forming an ejection-test pattern, the processes of forming the first test pattern, inspecting the color-ink nozzle again, and performing the cleaning process of the color-ink nozzle may be repeated until the ejection failure in the color-ink nozzle becomes unrecognizable. By repeating such processes, it is possible to eliminate the ejection failure in the color-ink nozzle even more certainly.

In such a method for forming an ejection-test pattern, if the ejection failure in the color-ink nozzle is not recognized, then the second test pattern may be formed. By forming the second test pattern in such a state, it is possible to certainly form the color-ink pattern.

In such a method for forming an ejection-test pattern, the first test pattern and the second test pattern may be formed on the same medium. By forming the two test patterns on the same medium in this way, it is possible to reduce waste of media.

In such a method for forming an ejection-test pattern, the color-ink nozzle may be capable of ejecting color inks of a plurality of colors, and the color ink that is ejected for forming the second test pattern may be a color ink, among the color inks of the plurality of colors, other than a color ink of the lightest color. By using a color ink, among the color inks of the plurality of colors, other than that of the lightest color, it is possible to satisfactorily form the test pattern for the clear-ink nozzle.

In such a method for forming an ejection-test pattern, the clear-ink nozzle or the color-ink nozzle may be provided with a plurality of nozzles for ejecting the clear ink or the color ink; and the first test pattern or the second test pattern may include patterns for each of the nozzles. Further, it is possible to inspect ejection separately for each nozzle based on the above-mentioned test pattern. By forming patterns separately for each of the nozzles, it is possible to easily inspect ejection, even when there are a plurality of nozzles that eject clear ink. Further, the patterns for each of the nozzles may be formed in a block shape.

It is also possible to achieve a method for forming an ejection-test pattern as follows:

A method for forming an ejection-test pattern, comprises the steps of:

forming, on a medium, a first test pattern that is used for inspecting ejection of a color-ink nozzle by ejecting a color ink from the color-ink nozzle;

inspecting the ejection of the color-ink nozzle by detecting the first test pattern with a sensor; and after inspecting the ejection of the color-ink nozzle, forming, on a medium, a second test pattern that is used for inspecting ejection of a clear-ink nozzle, the second test pattern being made using the color ink ejected from the color-ink nozzle and a clear ink ejected from the clear-ink nozzle;

wherein, before forming the second test pattern, a cleaning process of the color-ink nozzle, a process of forming the first test pattern again after performing the cleaning process, and a process of inspecting the ejection of the color-ink nozzle again based on the first test pattern that has been formed again are repeated until ejection failure in the color-ink nozzle becomes unrecognizable;

wherein, after the ejection failure in the color-ink nozzle becomes unrecognizable, the second test pattern is formed;

wherein the first test pattern and the second test pattern are formed on the same medium;

wherein the color-ink nozzle is capable of ejecting color inks of a plurality of colors, and the color ink that is ejected for forming the second test pattern is a color ink, among the color inks of the plurality of colors, other than a color ink of the lightest color;

wherein the clear-ink nozzle or the color-ink nozzle is provided with a plurality of nozzles for ejecting the clear ink or the color ink; and wherein the first test pattern or the second test pattern includes patterns for each of the nozzles.

It is also possible to achieve a method for testing ejection as follows:

A method for testing ejection, comprises the steps of:

forming, on a medium, a first test pattern that is used for inspecting ejection of a color-ink nozzle by ejecting a color ink from the color-ink nozzle;

inspecting the ejection of the color-ink nozzle using the first test pattern;

after inspecting the ejection of the color-ink nozzle, forming, on a medium, a second test pattern that is used for inspecting ejection of a clear-ink nozzle, the second test pattern being made using the color ink ejected from the color-ink nozzle and a clear ink ejected from the clear-ink nozzle; and inspecting the ejection of the clear-ink nozzle using the second test pattern.

In the above-mentioned method for testing ejection, if it is recognized that there is ejection failure in the clear-ink nozzle as a result of inspecting the ejection of the clear-ink nozzle, then the clear-ink nozzle may be subjected to a cleaning process. By inspecting ejection of the clear-ink nozzle, it is possible to check ejection failure of the clear-ink nozzle.

It is also possible to achieve a printing apparatus as follows:

A printing apparatus comprises:

a clear-ink nozzle for ejecting a clear ink;

a color-ink nozzle for ejecting a color ink; and a controller for controlling ejection of ink from the clear-ink nozzle and the color-ink nozzle;

wherein the controller causes a first test pattern that is used for inspecting ejection of the color-ink nozzle to be formed on a medium by ejecting the color ink from the color-ink nozzle;

causes the ejection of the color-ink nozzle to be inspected using the first test pattern; and after inspecting the ejection of the color-ink nozzle, causes a second test pattern that is used for inspecting ejection of the clear-ink nozzle to be formed on a medium, the second test pattern being made using the color ink ejected from the color-ink nozzle and the clear ink ejected from the clear-ink nozzle.

It is also possible to achieve a computer-readable medium as follows:

A computer-readable medium comprises:

a code for causing a first test pattern that is used for inspecting ejection of a color-ink nozzle to be formed on a medium by ejecting a color ink from the color-ink nozzle;

a code for causing the ejection of the color-ink nozzle to be inspected using the first test pattern; and a code for causing a second test pattern that is used for inspecting ejection of a clear-ink nozzle to be formed on a medium after inspecting the ejection of the color-ink nozzle, the second test pattern being made using the color ink ejected from the color-ink nozzle and a clear ink ejected from the clear-ink nozzle.

It is also possible to achieve a printing system as follows:

A printing system comprises:

a computer; and a printing apparatus that is connectable to the computer, the printing apparatus including:

a clear-ink nozzle for ejecting a clear ink;

a color-ink nozzle for ejecting a color ink; and a controller for controlling ejection of ink from the clear-ink nozzle and the color-ink nozzle;

wherein the controller causes a first test pattern that is used for inspecting ejection of the color-ink nozzle to be formed on a medium by ejecting the color ink from the color-ink nozzle;

causes the ejection of the color-ink nozzle to be inspected using the first test pattern; and after inspecting the ejection of the color-ink nozzle, causes a second test pattern that is used for inspecting ejection of the clear-ink nozzle to be formed on a medium, the second test pattern being made using the color ink ejected from the color-ink nozzle and the clear ink ejected from the clear-ink nozzle.

===Outline of Printing Apparatus===

Figure 2:
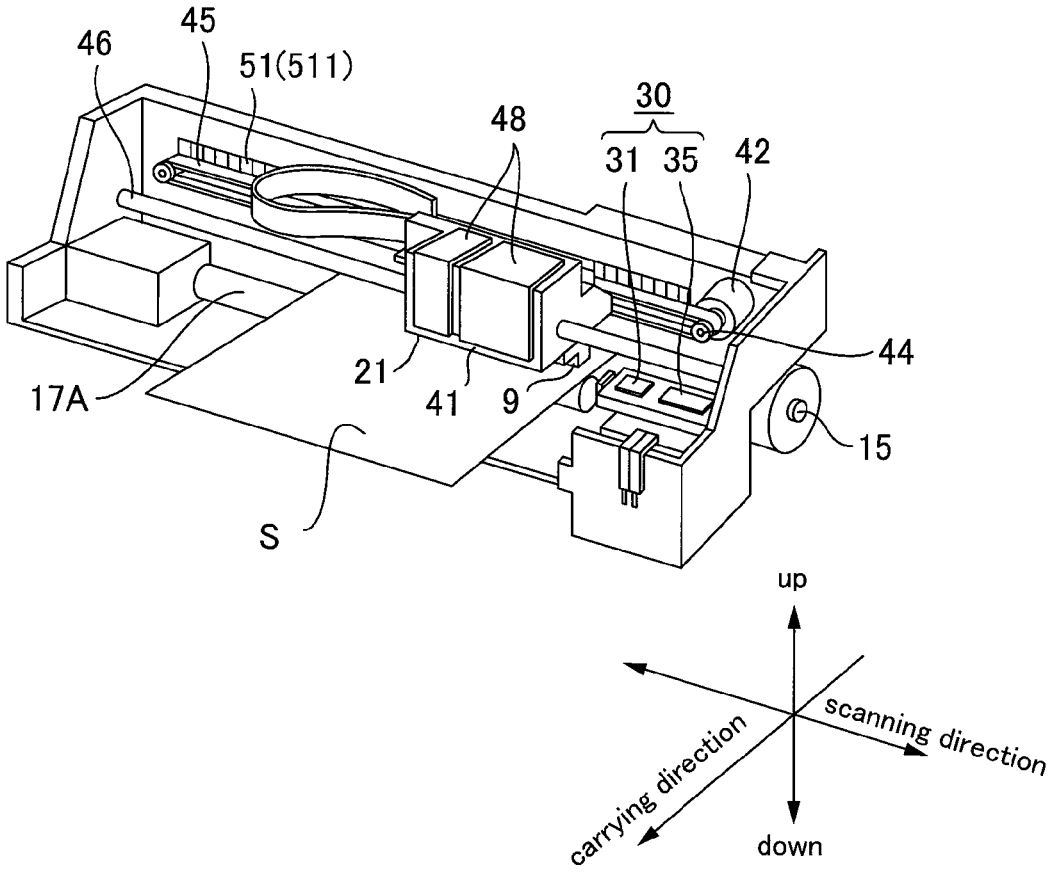
FIG. 2 is a diagram of the internal configuration of the inkjet printer.
Figure 3:
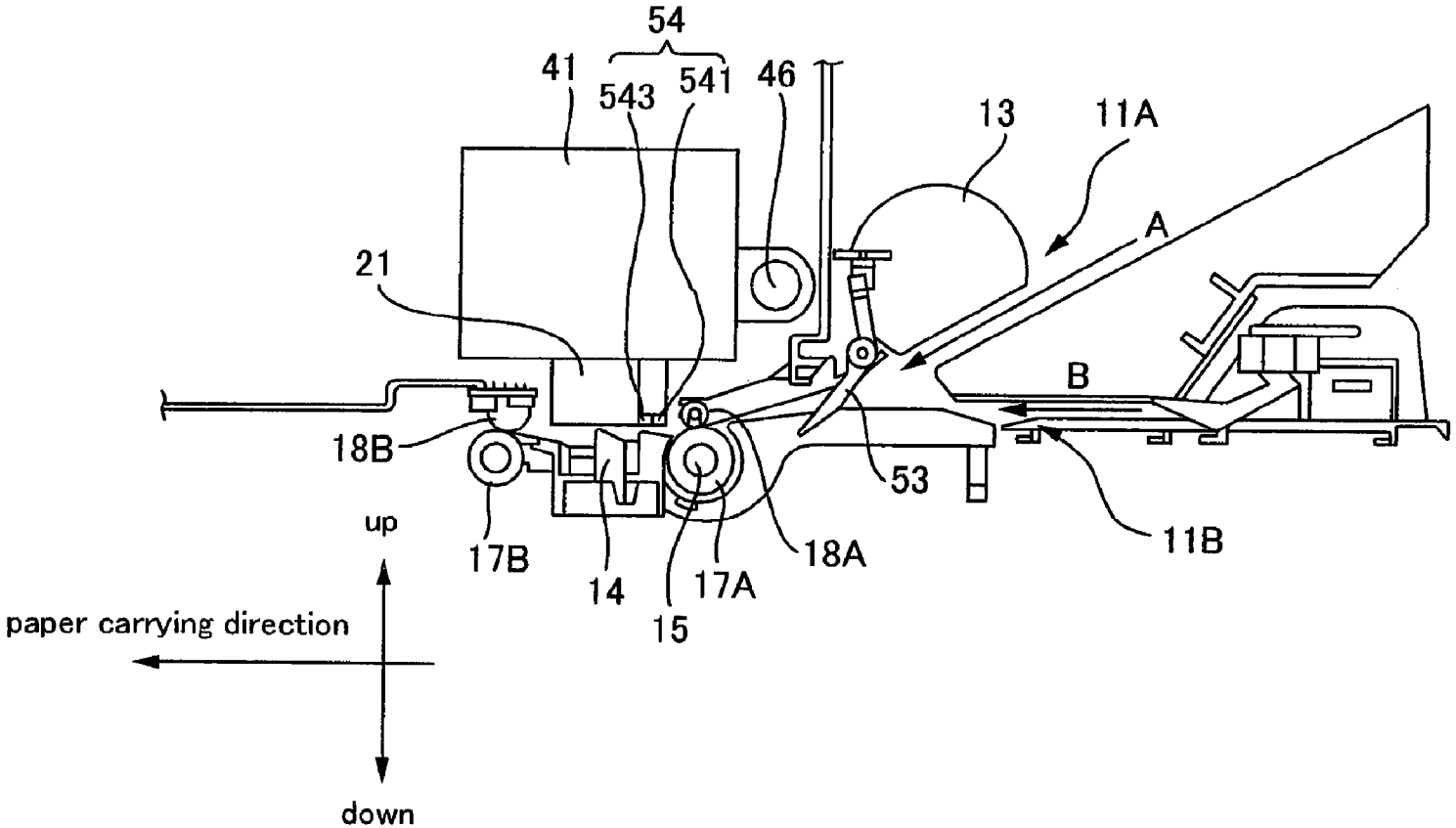
FIG. 3 is a cross sectional view of a carrying section of the inkjet printer.
Figure 4:
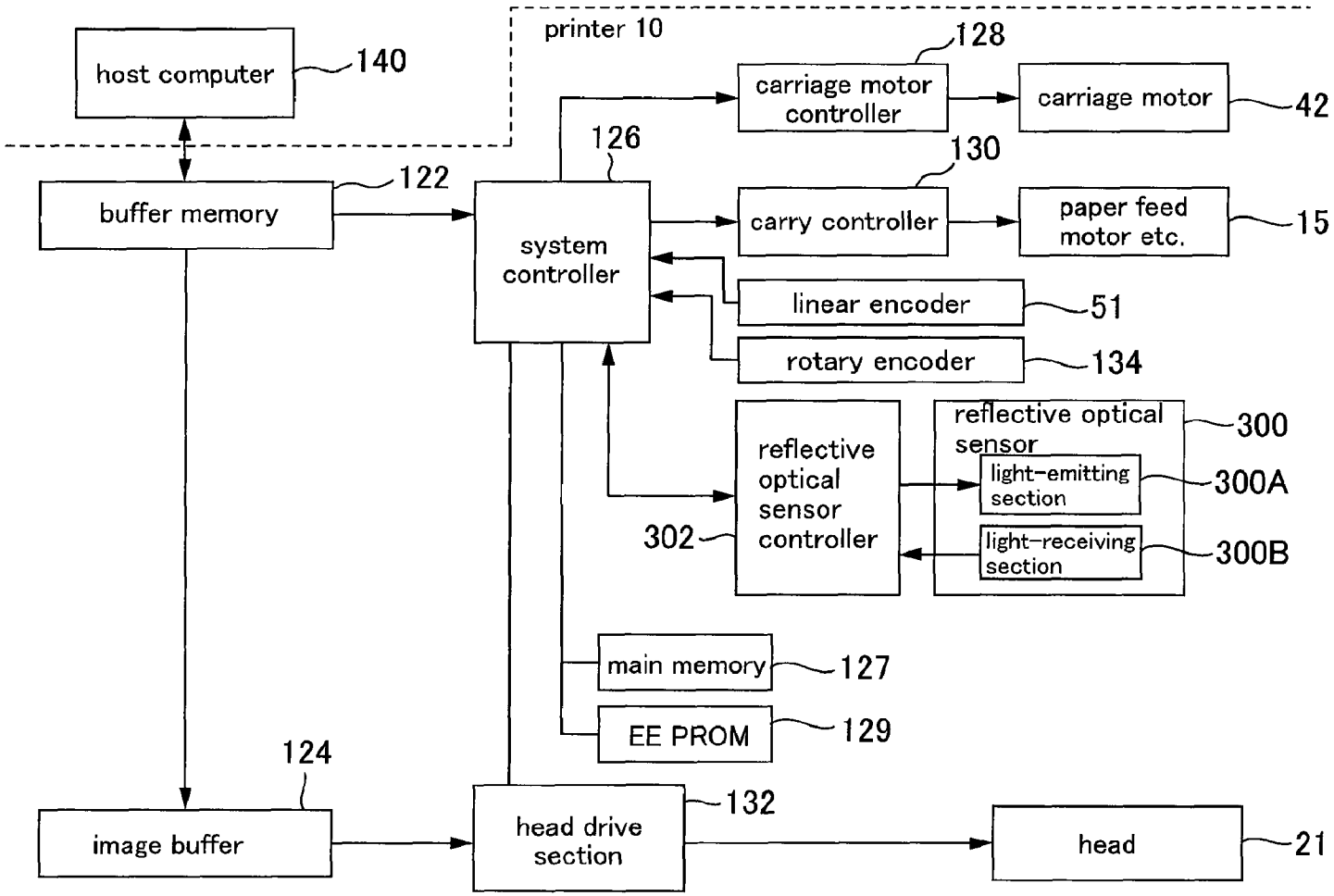
FIG. 4 is a block diagram showing a system configuration of the inkjet printer.

An embodiment of a printing apparatus according to the present invention is described with an inkjet printer serving as an example. FIGS. 1 to 4 show an example of an inkjet printer. FIGS. 1 to 4 are figures for describing the outline of one embodiment of the inkjet printer 1. FIG. 1 shows an external view of one embodiment of the inkjet printer 1. FIG. 2 show the internal configuration of the inkjet printer 1. FIG. 3 shows the carrying section of the inkjet printer 1. FIG. 4 is a block diagram showing the system configuration of the inkjet printer.

As shown in FIG. 1, the inkjet printer 1 is provided with a structure in which a medium such as print paper that is supplied from the rear side is discharged from the front side. A control panel 2 and a discharge portion 3 are arranged at the front side portion, and a paper supply portion 4 is provided at the rear side portion. Various control buttons 5 and display lamps 6 are arranged on the control panel 2. Furthermore, a discharge tray 7 is arranged at the discharge portion 3 and covers the paper discharge outlet when not in use. A paper supply tray 8 is arranged at the paper supply portion 4 to hold cut paper (not shown). It should be noted that the inkjet printer 1 may be provided with a paper feed structure that is capable of being used in printing not only print paper in single sheets, such as cut paper, but also media that are continuous, such as roll paper.

As shown in FIG. 2, a carriage 41 is arranged inside the inkjet printer 1. The carriage 41 is arranged such that it can move relatively in a predetermined direction (the scanning direction shown in the drawing in this embodiment). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a driving force for moving the carriage 41 relatively in the predetermined direction. Furthermore, the timing belt 45 is connected to the carriage motor 42 via the pulley 44, and a portion of it is also connected to the carriage 41, such that the carriage 41 is moved relatively in the predetermined direction by the rotational force of the carriage motor 42. The guide rail 46 guides the carriage 41 along the predetermined direction. In addition to these, also provided in the vicinity of the carriage 41 are a linear encoder 51 that detects a position of the carriage 41, a carry roller 17A for carrying a medium S along a direction that intersects with the movement direction of the carriage 41, and a paper feed motor (which is also referred to as a "paper carry motor") 15 that rotationally drives the carry roller 17A.

On the other hand, ink cartridges 48 that contain the various inks and a print head 21 that carries out printing on the medium S are arranged at the carriage 41. The ink cartridges 48 contain color inks such as yellow (Y), magenta (M), cyan (C), and black (K) for example, and are mounted in a carriage mounting portion provided in the carriage 41 so as to be removable. On the other hand, in this embodiment, the print head 21 carries out printing by ejecting ink on the medium S. To do so, a multitude of nozzles for ejecting ink are provided in the print head 21. Detailed description of the ink ejecting mechanism of the print head 21 is given later.

Additionally, a cleaning unit 30 for clearing clogging of the nozzles of the print head 21 is arranged inside the inkjet printer 1. The cleaning unit 30 has a pump device 31 and a capping device 35. The pump device 31 sucks out ink from the nozzles in order to prevent clogging of the nozzles of the print head 21 and is operated by a pump motor (not shown). On the other hand, the capping device 35 is for sealing the nozzles of the head 21 when printing is not being performed (for example, during standby) so that the nozzles of the print head 21 are kept from clogging.

The following is a description of the configuration of a carrying section (which corresponds to carrying means in the present invention) of the inkjet printer 1. As shown in FIG. 3, the carrying section has a paper insert opening 11A and a roll paper insert opening 11B, a paper supply motor (not shown), a paper supply roller 13, a platen 14, a paper feed motor (hereinafter, also referred to as PF motor) 15, a carry roller 17A and paper discharge rollers 17B, and free rollers 18A and free rollers 18B.

The paper insert opening 11A is where paper S, which is a medium, is inserted. The paper supply motor (not shown) is a motor for carrying the paper S that has been inserted into the paper insert opening 11A into the printer 1, and is constituted by a pulse motor or the like. The paper supply roller 13 is a roller for automatically carrying the medium S that has been inserted into the paper insert opening 11A into the printer 1, and is driven by the paper supply motor. The paper supply roller 13 has a transverse cross-sectional shape that is substantially the shape of the letter D. The peripheral length of a circumference section of the paper supply roller 13 is set longer than the carrying distance to the PF motor 15, so that using this circumference section, the medium S can be carried up to the PF motor 15. It should be noted that a plurality of sheets of the medium S are prevented from being supplied at one time by the rotational drive force of the paper supply roller 13 and the friction resistance of separating pads (not shown).

The platen 14 is a support means that supports the paper S during printing. The PF motor 15 is a motor for feeding paper, which is an example of a medium S, in the paper carrying direction, and is constituted by a DC motor. The carry roller 17A is a roller for feeding the paper S, which has been carried into the printer 1 by the paper supply roller 13, up to a printable region, and is driven by the PF motor 15. The free rollers 18A are provided in a position that is in opposition to the carry roller 17A, and push the paper S toward the carry roller 17A by sandwiching the paper S between them and the carry roller 17A.

The paper discharge rollers 17B are rollers for discharging the paper S for which printing has finished to outside the printer 1. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The following is a description concerning the system configuration of the inkjet printer 1. As shown in FIG. 4, the inkjet printer 1 is provided with a buffer memory 122, an image buffer 124, a system controller (which is also referred to below as a "controller") 126, a main memory 127, and an EEPROM 129. The buffer memory 122 receives and temporarily stores various data such as print data sent from a host computer 140. The image buffer 124 obtains the received print data from the buffer memory 122 and stores it. Furthermore, the main memory 127 is constituted by a ROM and a RAM, for example.

On the other hand, the system controller 126 reads out a control program from the main memory 127 and controls the entire printer unit 20 in accordance with the control program. The system controller 126 of the present embodiment is connected to a carriage motor controller 128, a carry controller 130, a head drive section 132, a rotary encoder 134, and a linear encoder 51.

The carriage motor controller 128 performs drive control of the carriage motor 42 for such aspects as rotational direction, number of rotations, torque and the like.

The head drive section 132 performs drive control of the print head 21. The carry controller 130 controls the various drive motors that are arranged in a carry system, such the paper carry motor 15 that rotationally drives the carry roller 17A.

Print data that have been transferred from the host computer 140 are temporarily held in the buffer memory 122. Necessary information contained in the print data held here is read out by the system controller 126. Based on the information that is read out, the system controller 126 controls the carriage motor controller 128, the carry controller 130, and the head drive section 132 in accordance with a control program while referencing the output from the linear encoder 51 and the rotary encoder 134.

Print data for a plurality of color components received by the buffer memory 122 is stored in the image buffer 124. The head drive section 132 obtains the print data for each of the color components from the image buffer 124 in accordance with control signals from the system controller 126, and drives and controls the nozzles for each color provided in the print head 21 based on the print data.

Additionally, the system controller 126 of the present embodiment is provided with a reflective optical sensor controller 132. The reflective optical sensor controller 302 performs drive control of a reflective optical sensor 300. The reflective optical sensor 300 is provided with a light-emitting section 300A constituted by a light-emitting diode or the like and a light-receiving section 300B constituted by a phototransistor or the like. The reflective optical sensor controller 302 fulfils such roles as performing light-emission control of the light-emitting section 300A of the reflective optical sensor 300 and transmitting to the system controller 126 information about the reflected light received at the light-receiving section 300B. The reflective optical sensor 300 is arranged on the carriage 41 such that light can be emitted from the light-emitting section 300A toward the medium S and moves with the carriage relatively with respect to the medium S.

===Example Configuration of Reflective Optical Sensor===

Figure 5:
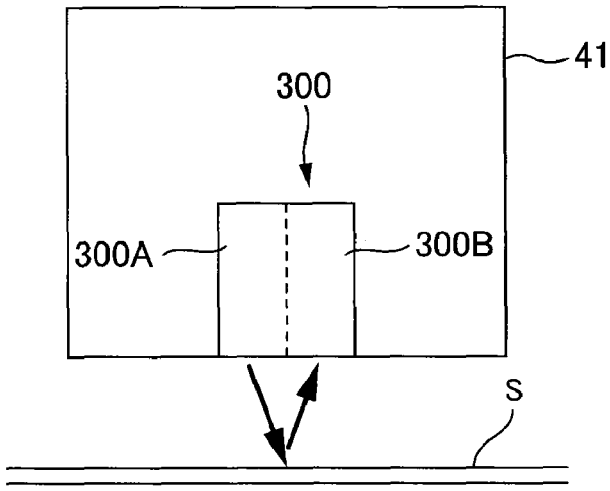
FIG. 5 is an explanatory diagram showing a configuration of a reflective optical sensor.

FIG. 5 is a schematic diagram showing an embodiment in which the reflective optical sensor 300 is used as a sensor. As shown in this figure, the reflective optical sensor 300 is arranged on the carriage 41 such that it moves with the carriage 41 relatively with respect to the medium S.

The light-emitting section 300A of the reflective optical sensor 300 is set up such that light is irradiated toward the medium S at a predetermined angle. On the other hand, the light-receiving section 300B is configured such that light (including regular reflection light and diffused reflection light) reflected by the surface of the medium S is detected. In this way, the reflective optical sensor 300 is able to measure the amount of reflected light received by the light-receiving section 300B and detect such aspects as glossiness of the medium S and color darkness. The detection results of the reflective optical sensor 300 are output to the system controller 126.

It should be noted that in this embodiment the light-emitting section 300A and the light-receiving section 300B are arranged adjacent to each other, but they may be arranged separately with a spacing between each other.

===Linear Encoder===

Figure 6:
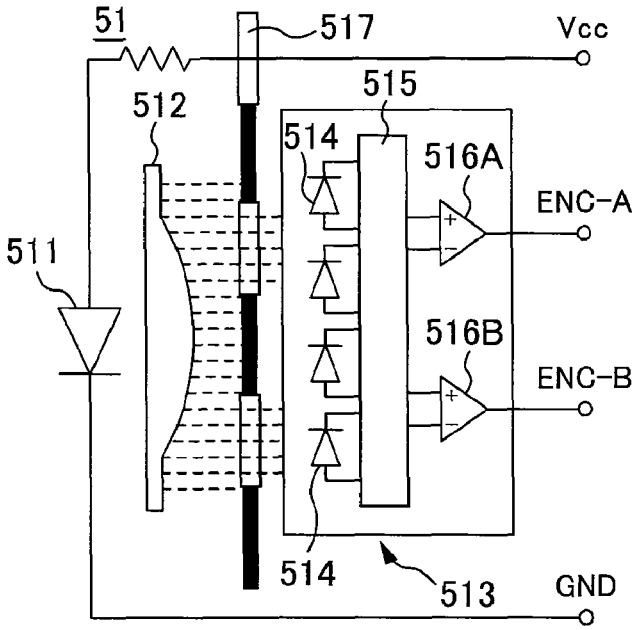
FIG. 6 is an explanatory diagram of a linear encoder.

The following is a detailed description of the linear encoder 51. FIG. 6 schematically shows the configuration of the linear encoder 51 provided to the carriage 41.

The linear encoder 51 is provided with a light-emitting diode 511, a collimating lens 512, and a detection processing section 513. The detection processing section 513 has a plurality (for instance, four) photodiodes 514, a signal processing circuit 515, and, for example, two comparators 516A and 516B.

The light-emitting diode 511 emits light when a voltage VCC is applied to it via resistors on both sides. This light is condensed into parallel light by the collimating lens 512 and passes through a linear encoder code plate 517. The linear encoder code plate 517 is provided with slits at a predetermined spacing (for example, 1/180 inch (1 inch=2.54 cm)).

The parallel light that passes through the linear encoder code plate 517 then passes through stationary slits, which are not shown, and is incident on the photodiodes 514, where it is converted into electric signals. The electric signals that are output from the four photodiodes 514 are subjected to signal processing in the signal processing circuit 515, and the signals that are output from the signal processing circuit 515 are compared in the comparators 516A and 516B, and the results of these comparisons are output as pulses. A pulse ENC-A and pulse ENC-B that are output from the comparators 516A and 516B become the output of the linear encoder 51.

Figure 7A:
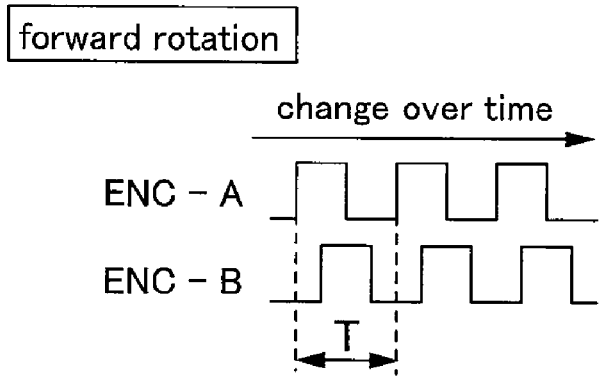
FIG. 7A is a first timing chart showing output waveforms of the linear encoder.
Figure 7B:
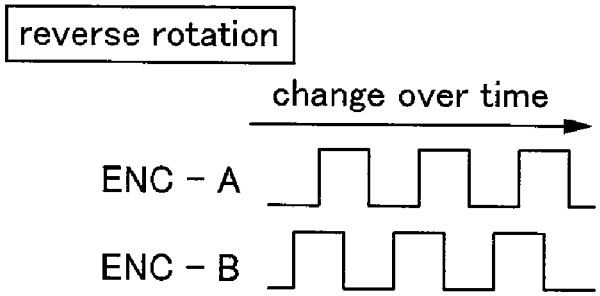
FIG. 7B is a second timing chart showing output waveforms of the linear encoder.

FIG. 7A and FIG. 7B are timing charts showing the waveforms of the two output signals of the linear encoder 51 when the carriage motor 42 is rotating forward, and when it is rotating in reverse.

As shown in FIGS. 7A and 7B, the phases of the pulse ENC-A and the pulse ENC-B are misaligned by 90 degrees both when the carriage motor 42 is rotating forward and when it is rotating in reverse. When the carriage motor 42 is rotating forward, that is, when the carriage 41 is moving along the guide shaft 70, then, as shown in FIG. 7A, the phase of the pulse ENC-A leads the phase of the pulse ENC-B by 90 degrees. On the other hand, when the carriage motor 42 is rotating in reverse, then, as shown in FIG. 7B, the phase of the pulse ENC-A is delayed by 90 degrees with respect to the phase of the pulse ENC-B. A single period T of the pulse ENC-A and the pulse ENC-B is equivalent to the time during which the carriage 41 is moved by the slit spacing of the linear encoder code plate 517.

Then, the rising edge and the rising edge of the output pulses ENC-A and ENC-B of the linear encoder 51 are detected, and the number of detected edges is counted. The rotational position of the carriage motor 42 is calculated based on the value of the count. With respect to the calculation, when the carriage motor 42 is rotating forward, a "+1" is added for each detected edge, and when it is rotating in reverse, a "−1" is added for each detected edge. The period of the pulses ENC-A and ENC-B is equal to the time from when one slit of the linear encoder code plate 517 passes the linear encoder 51 to when the next slit passes the linear encoder 51, and the phases of the pulse ENC-A and the pulse ENC-B are misaligned by 90 degrees. Accordingly, a count number of "1" of the calculation corresponds to ¼ of the slit spacing of the linear encoder code plate 517. Therefore, if the counted value is multiplied by ¼ of the slit spacing, then the amount that the carriage motor 42 has moved from the rotational position corresponding to the count value "0" can be obtained based on this product. The resolution of the linear encoder 51 at this time is ¼ the slit spacing of the linear encoder code plate 517.

===Print Head===

Figure 8:
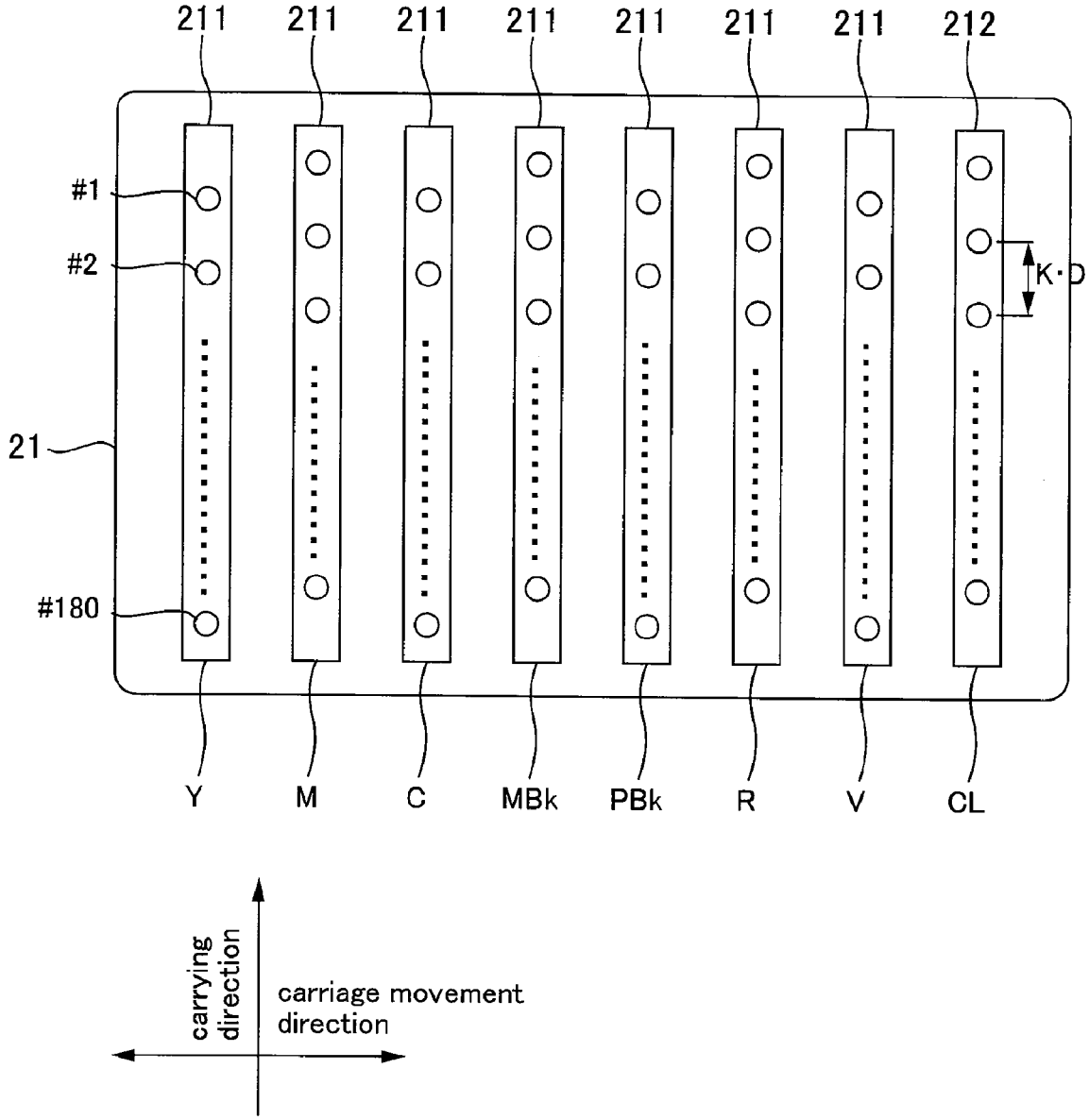
FIG. 8 is a diagram showing the print head as viewed from the bottom surface.

FIG. 8 is a diagram showing the arrangement of ink nozzles on the bottom surface of the print head 21. As shown in FIG. 8, a nozzle row 211 made of a plurality of nozzles #1 to #180 is arranged on the bottom surface of the print head 21 for each of the colors yellow (Y), magenta (M), cyan (C), matte black (MBk), photo black (PBk), red (R), and violet (V). Further still, in the present embodiment, in addition to the color nozzle rows 211, a clear ink (CL) nozzle row 212 (this corresponds to the clear-ink nozzle in the present invention) is provided. It should be noted that the color nozzle rows 211 of yellow (Y), magenta (M), cyan (C), matte black (MBk), photo black (PBk), red (R), and violet (V) correspond to the color-ink nozzles in the present invention. On the other hand, the clear ink (CL) nozzle row 212 corresponds to the clear-ink nozzle in the present invention. Furthermore, in the present invention, colors other than those mentioned above, such as blue and green, may be used as color inks.

The nozzles #1 to #180 in each of the nozzle rows 211 and 212 are arranged linearly along the carrying direction of the medium S. The nozzle rows 211 and 212 are arranged parallel to and spaced from one another in the movement direction (scanning direction) of the print head 21. Each of the nozzles #1 to #180 is provided with a piezo element (not shown) as a drive element for ejecting droplets of ink.

Here, "D" is the minimum dot pitch (i.e., the interval between dots formed on the medium S at the highest resolution) in the carrying direction of the medium S. Further, "k" is an integer of one or more. The interval between the nozzles #1 to #180 of each nozzle row 211 and 212 is set to "k·D", that is, set to an integral multiple of the interval between dots formed on the medium S at the highest resolution.

When a voltage of a predetermined duration is applied between electrodes provided on both sides of the piezo element, the piezo element expands while the voltage is being applied, thereby changing the shape of the side wall of the ink channel. As a result, the volume of the ink channel is constricted by an amount of the expansion of the piezo element, and ink corresponding to this amount of constriction becomes an ink droplet, which is ejected from the relevant nozzle #1 to #180 of a relevant color.

Figure 9:
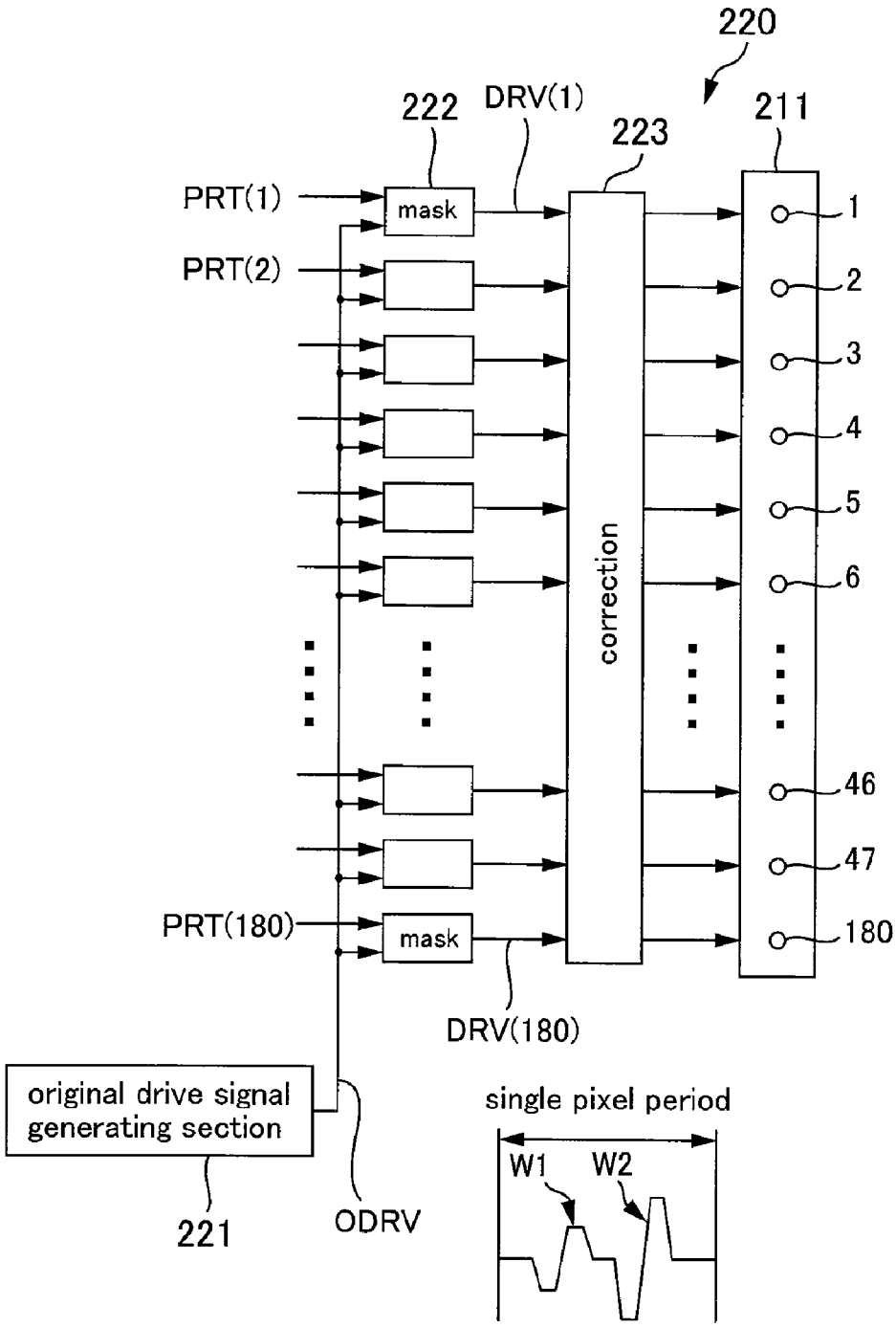
FIG. 9 is a circuit diagram showing one embodiment of a nozzle drive circuit.

FIG. 9 shows a drive circuit 220 of the nozzles #1 to #180. As shown in FIG. 9, the drive circuit 220 is provided with an original drive signal generating section 221, a plurality of mask circuits 222, and a drive signal correction circuit 223. The original drive signal generating section 221 creates an original signal ODRV that is shared by the nozzles #1 to #180. As shown in a lower portion of FIG. 9, the original signal ODRV is a signal that includes two pulses, a first pulse W1 and a second pulse W2 during the main scanning period of a single pixel (during the period that the carriage 41 crosses over a single pixel). The original signal ODRV created by the original drive signal generating section 221 is output to each mask circuit 222.

The mask circuits 222 are provided each corresponding to one of the plurality of piezo elements for driving the nozzles #1 to #180 of the print head 21. Each mask circuit 222 receives the original signal ODRV from the original signal generating section 221 and also receives print signals PRT(i). The print signal PRT(i) is pixel data corresponding to each pixel, and is a binary signal having 2-bit information corresponding to a single pixel. The bits respectively correspond to the first pulse W1 and the second pulse W2. The mask circuits 222 are gates for blocking the original signal ODRV or allowing it to pass depending on the level of the print signal PRT(i). That is, when the print signal PRT(i) is level "0," the pulse of the original signal ODRV is blocked, whereas when the print signal PRT(i) is level "1," the pulse corresponding to the original signal ODRV is allowed to pass as it is and is output to the drive signal correction circuit 223 as a drive signal DRV.

The drive signal correction circuit 223 performs correction by shifting the timing of the waveforms of the drive signals DRV from the mask circuits 222. The width by which the timing of the waveforms of the drive signals DRV, which are corrected here, is shifted is adjusted as appropriate based on instructions from the system controller 126, for example. That is, based on instructions from the system controller 126 for example, the drive signal correction circuit 223 can shift the waveforms of the drive signals DRV to a desired timing. The drive signals DRV that are corrected by the drive signal correction circuit 223 are output to the piezo elements of the nozzles #1 to #10. The piezo element of each nozzle #1 to #10 is driven by the drive signal DRV from the drive signal correction circuit 223 and ejects ink.

Figure 10:
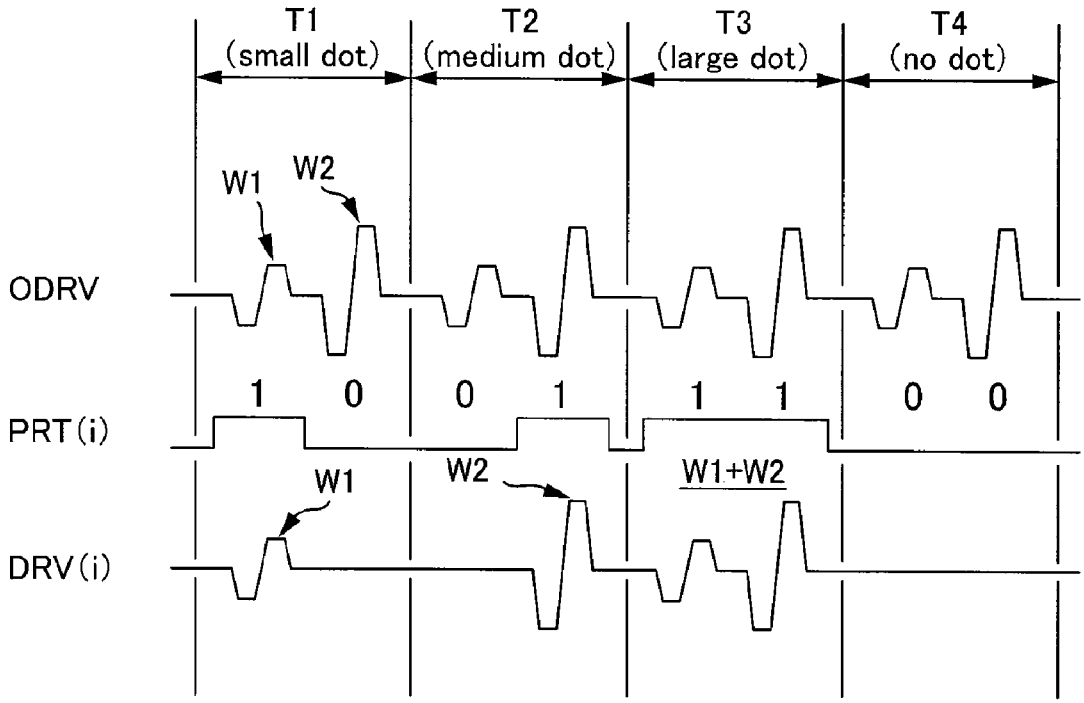
FIG. 10 is a timing chart of the original signal ODRV, the print signal PRT(i), and the drive signal DRV(i) indicating the operation of the drive signal generating section.

FIG. 10 is a timing chart of the original signal ODRV, the print signal PRT(i), and the drive signal DRV(i) indicating the operation of the drive signal generating section. As shown in FIG. 10, the original signal ODRV generates a first pulse W1 and a second pulse W2 in that order during each pixel period T1, T2, T3, and T4. It should be noted that "pixel period" has the same meaning as the movement interval of the carriage for a single pixel.

When the print signal PRT(i) corresponds to the two bits of pixel data "1,0" then only the first pulse W1 is output in the first half of the pixel period. Accordingly, a small ink droplet is ejected from the nozzle, forming a small-sized dot (small dot) on the medium. When the print signal PRT(i) corresponds to the two bits of pixel data "0,1" then only the second pulse W2 is output in the second half of the pixel period. Accordingly, a medium-sized ink droplet is ejected from the nozzle, forming a medium-sized dot (medium dot) on the medium. Furthermore, when the print signal PRT(i) corresponds to the two bits of pixel data "1,1" then the first pulse W1 and the second pulse W2 are output during the pixel period. Accordingly, a large ink droplet is ejected from the nozzle, forming a large-sized dot (large dot) on the medium. As described above, the drive signal DRV(i) in a single pixel period is shaped so that it may have three different waveforms corresponding to three different values of the print signal PRT(i), and based on these signals, the print head 21 can form dots of three different sizes and can adjust the amount of ejected ink within each pixel period. Furthermore, when the print signal PRT(i) corresponds to the two bits of pixel data "0,0" as in the pixel period T4, then no ink droplet is ejected from the nozzle and no dot is formed on the medium.

In the inkjet printer 1 according to the present embodiment, the drive circuits 220 of the nozzles #1 to #180 are arranged separately for each of the nozzle rows 211 and 212, that is, for each of the colors yellow (Y), magenta (M), cyan (C), matte black (MBk), photo black (PBk), red (R), and violet (V), and for clear ink (CL), such that piezo elements are driven separately for each nozzle row 211 and 212.

===Color Inks And Clear Ink===

Color ink and clear ink of the present invention are described below.

"Color ink" herein refers to colored, non-transparent inks such as yellow (Y), magenta (M), cyan (C), black (K), matte black (MBk), photo black (PBk), red (R), violet (V), light magenta (LM), light cyan (LC), dark yellow (DY), green (G), and blue (B). These color inks are made of dye ink, pigment ink, etc.

In contrast to color inks, "clear ink" generally refers to uncolored, transparent inks. However, there is no particular limitation to such uncolored, transparent inks, and it broadly refers to inks that are difficult to be detected by sensors such as the above-described reflective optical sensor when printed on the medium S, and includes colored transparent inks and colored non-transparent inks. That is, in contrast to "color inks", which are colored, non-transparent inks such as yellow (Y), magenta (M), cyan (C), and black (K) and detectable by a sensor installed to the printing apparatus such as the reflective optical sensor 300 when adhering to the medium S, "clear ink" refers to an ink that, even when adhering to the medium S, is extremely difficult to specify with a sensor whether it is adhering to the medium or not.

===Ejection Testing===

With the inkjet printer 1 according to the present embodiment, it is possible to test whether or not the above-described color inks of each color and clear ink are properly ejected from each of the nozzles #1 to #180 of each nozzle row 211 and 212, that is, it is possible to "detect missing dots". This ejection testing involves actually ejecting color inks or clear ink from each of the nozzles #1 to #180 to form predetermined test patterns on the medium S. Then, based on the test patterns that have been formed, whether or not there is ejection failure such as clogging in the nozzles #1 to #180 of each nozzle row is checked. If ejection failure is found in any of the nozzles #1 to #180 as a result of this check, then nozzle cleaning is performed for the nozzles #1 to #180 using, for example, the cleaning unit 30.

Figure 11:
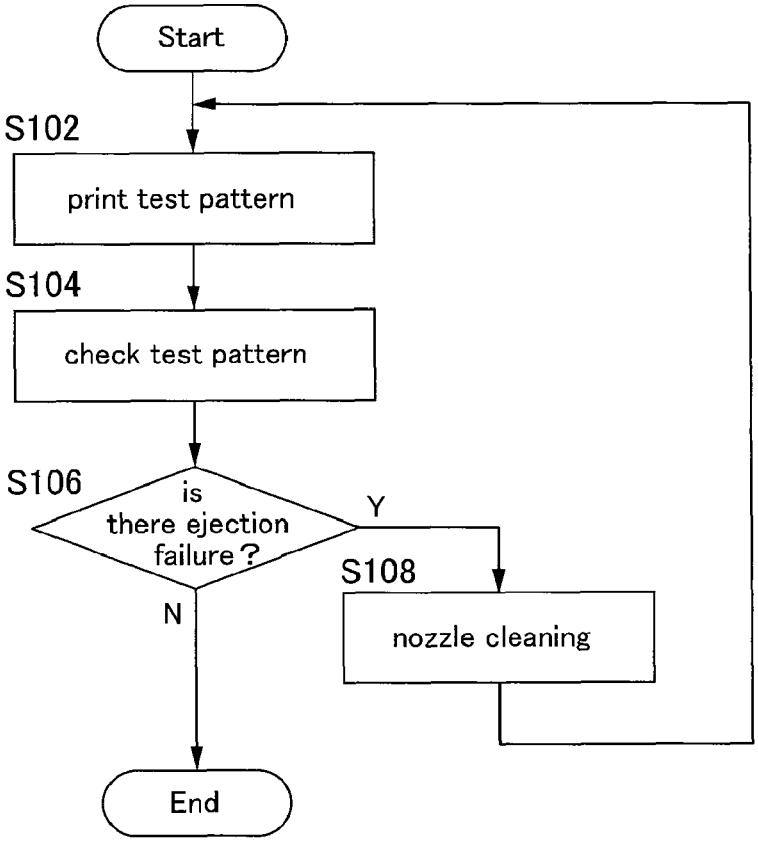
FIG. 11 is a flowchart showing an example of an ejection testing procedure.

FIG. 11 shows an example of an ejection testing procedure for an inkjet printer according to the present embodiment. As shown in FIG. 11, when carrying out ejection testing, first, color ink or clear ink is ejected from each of the nozzles #1 to #180 of each nozzle row 211 and 212 to form predetermined test patterns on the medium S (S102).

It should be noted that in the inkjet printer 1 according to the present embodiment, a test pattern used for testing ejection of the nozzles #1 to #180 of the color ink nozzle rows 211 for each color (corresponding to the first test pattern of the present invention), and a test pattern used for testing ejection of the nozzles #1 to #180 of the clear ink nozzle row 212 (corresponding to the second test pattern of the present invention) are formed. The test patterns that are formed here will be described in detail further below.

After forming the predetermined test patterns in this way, next, checking is performed based on the test patterns that have been formed (S104). This checking is performed by the reflective optical sensor 300 provided on the carriage 41 of the inkjet printer 1. The test patterns formed on the medium S are detected by the reflective optical sensor 300, and based on the detection results, it is checked whether or not there is ejection failure in any of the nozzles #1 to #180 of the color ink nozzle rows 211 for each color or any of the nozzles #1 to #180 of the clear ink nozzle row 212 (S106). If it is determined that there is an ejection failure, then nozzle cleaning is performed (S108). Detailed description on nozzle cleaning is given later. On the other hand, if it is determined that there is no ejection failure in any of the nozzle rows 211 and 212, then the process is ended immediately.

First Embodiment

The first embodiment regarding a method for forming an ejection-test pattern and a method for testing ejection will be described next.

In the first embodiment, when forming an ejection-test pattern for a clear ink, a clear ink is ejected toward a medium from a clear ink nozzle row 212 to form the ejection-test pattern; and a color ink is ejected toward a region in which the clear ink is to adhere from at least two color ink nozzles 211 to form the ejection-test pattern.

Further, ejection of the clear ink is inspected using the ejection-test pattern that has been formed in this way.

Further, the system controller (controller) 126 provided in the inkjet printer 1 controls ink ejection of the clear-ink nozzle 212 and the color-ink nozzles 211. The system controller 126 causes the clear-ink nozzle 212 to eject the clear ink toward a medium to form an ejection-test pattern for the clear ink; and causes at least two color-ink nozzles 211 to eject the color ink toward a region in which the clear ink is to adhere to form the ejection-test pattern.

Further, a computer-readable medium (main memory 127, EEPROM 129, etc.) stores the following codes: a code for causing a clear-ink nozzle 212 to eject a clear ink toward a medium to form an ejection-test pattern for the clear ink; and a code for causing at least two color-ink nozzles 211 to eject a color ink toward a region in which the clear ink is to adhere to form the ejection-test pattern.

This is described in detail below.

===Color Ink Test Pattern===

The color-ink test pattern formed by the printer 1 according to the present embodiment is described next.

Figure 12:
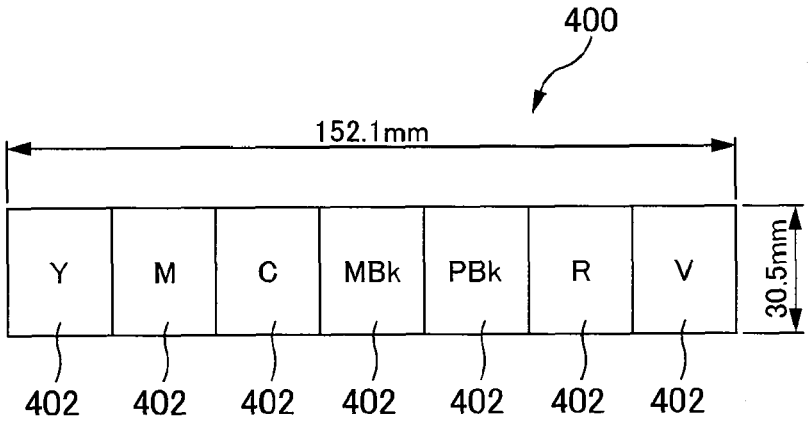
FIG. 12 is a diagram showing one example of a color-ink test pattern.

FIG. 12 shows an overview of a test pattern 400 used for testing ejection of each of the nozzles #1 to #180 of the color ink nozzle rows 211 for each color. As shown in FIG. 12, the test pattern 400 is constituted by rectangular patterns 402 formed by the respective color inks of the colors yellow (Y), magenta (M), cyan (C), matte black (MBk), photo black (PBk), red (R), and violet (V). In the present embodiment, the color block-shaped patterns 402 are formed and arranged lined up laterally in a row along the movement direction of the carriage 41, as shown in the figure. In the pattern 402 for each color, block-shaped patterns are formed corresponding to each of the nozzles #1 to #180 for each color. It should be noted that each of the nozzles #1 to #180 of the nozzle rows 211 for each color of yellow (Y), magenta (M), cyan (C), matte black (MBk), photo black (PBk), red (R), and violet (V) corresponds to the color-ink nozzle of the present invention. Further, each of the nozzles #1 to #180 of the nozzle row 212 for the clear ink (CL) corresponds to the clear-ink nozzle of the present invention.

Figure 13:
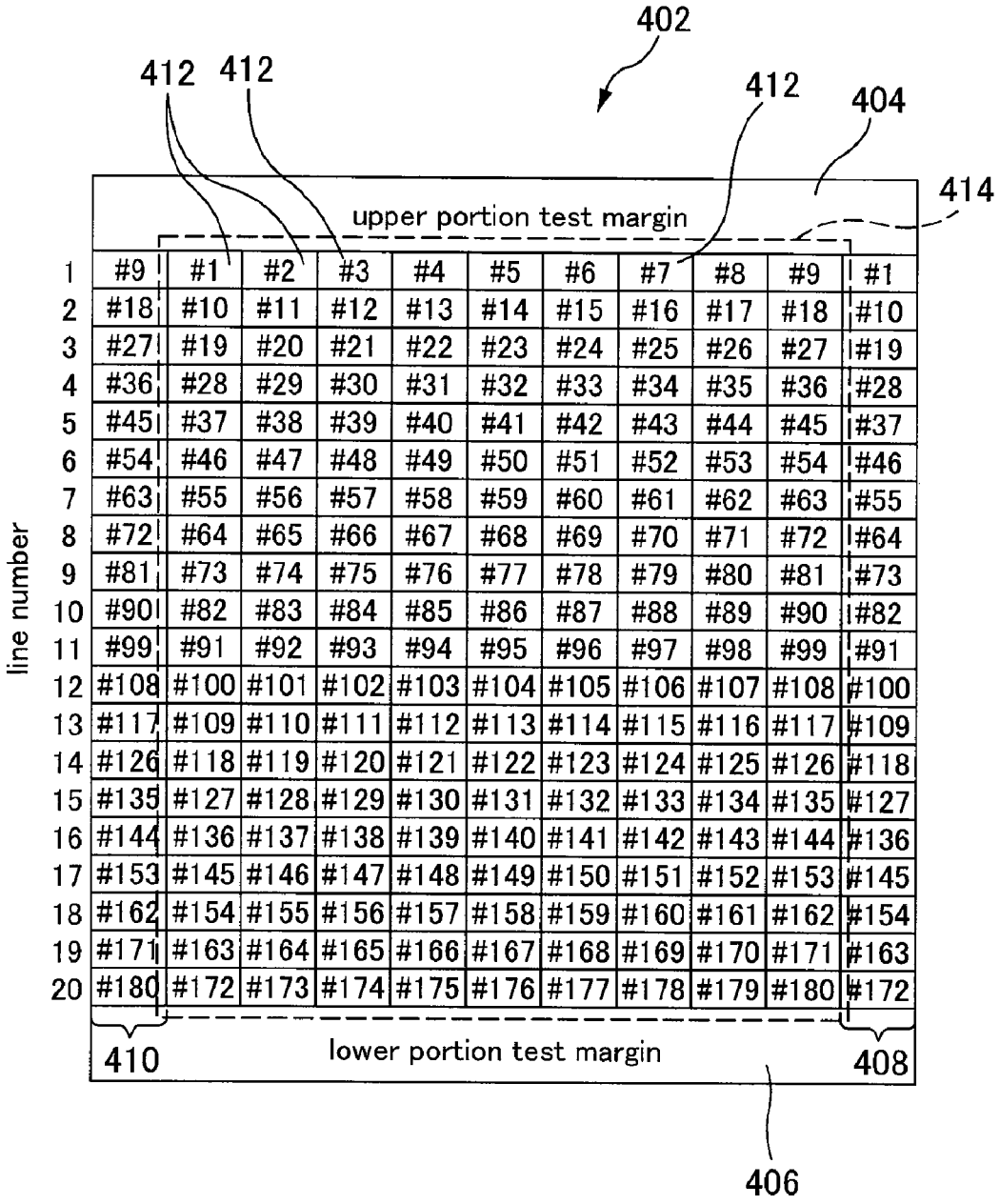
FIG. 13 is a detailed diagram of the test pattern of a given color.

FIG. 13 describes an enlarged and detailed view of the configuration of each of the block-shaped patterns 402. As shown in FIG. 13, in the respective upper, lower, left, and right side portions of the pattern 402 are provided an upper portion test margin 404, a lower portion test margin 406, a right portion test margin 408, and a left portion test margin 410, and further, a test pattern group 414 for the individual nozzles including a plurality of block-shaped test patterns 412 is provided so as to be enclosed within the test margins 404, 406, 408, and 410. The upper portion test margin 404 is formed with color ink ejected from the nozzles #1 to 8 and #10 to #17 of the color ink nozzle row 211 for each color, and the lower portion test margin 406 is formed with color ink ejected from the nozzles #163 to #170 and #172 to #179 of the color ink nozzle row 211 for each color. Further, the right portion test margin 408 and the left portion test margin 410 are formed, respectively, with color ink ejected from the nozzles of the color ink nozzle row 211 for each color that correspond to the nozzle numbers (#1 to #180) shown in the figure.

On the other hand, each of the test patterns 412 formed in the test pattern group 414 for the individual nozzles is formed with color ink ejected from a nozzle of the color ink nozzle row 211 for each color that corresponds to the nozzle number (#1 to #180) shown in the figure. In other words, one test pattern 412 is allocated to each nozzle in the color ink nozzle row 211 for each color, and each block-shaped pattern 412 is formed only by the color ink ejected from the nozzle that corresponds thereto. That is, test patterns 412 corresponding to all of the nozzles #1 to #180 of a certain nozzle row 211 are formed in the test pattern group 414 for the individual nozzles. In the present embodiment, 20 rows of these block-shaped test patterns 412 are formed in the vertical direction of the paper face (the carrying direction of the medium S), and 9 columns of them are formed in the lateral direction of the paper face (the movement direction of the carriage 41); a total of 180 patterns, that is, patterns amounting to the number of nozzles #1 to #180 are provided.

Figure 14:
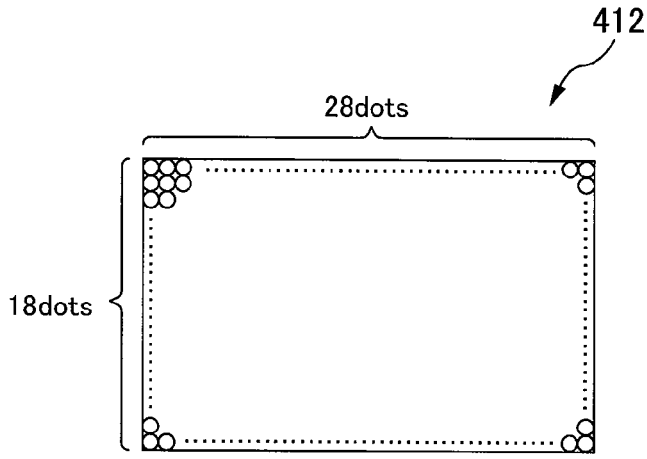
FIG. 14 is a detailed diagram of a pattern for each nozzle.

FIG. 14 describes in detail a single block-shaped test pattern 412 formed in the test pattern group 414 for the individual nozzles. As shown in the figure, a single test pattern 412 for each nozzle is constituted of a multitude of dots formed by the color ink, which has been ejected from the color-ink nozzles for each color, adhering to the medium S. The dots are formed with appropriate intervals therebetween in the lateral direction of the paper face (the movement direction of the carriage 41) and the vertical direction of the paper face (the carrying direction of the medium S). Here, in each test pattern 412, a total of 504 dots—28 dots in the lateral direction of the paper face (the movement direction of the carriage 41) and 18 dots in the vertical direction of the paper face (the carrying direction of the medium S)—are formed. In the present embodiment, large-sized ink droplets are ejected from each of the nozzles #1 to #180 of the color ink nozzle row 211 for each color, and each dot is formed as a large-sized dot (large dot).

===Clear Ink Test Pattern===

<Test Pattern>

Figure 15:
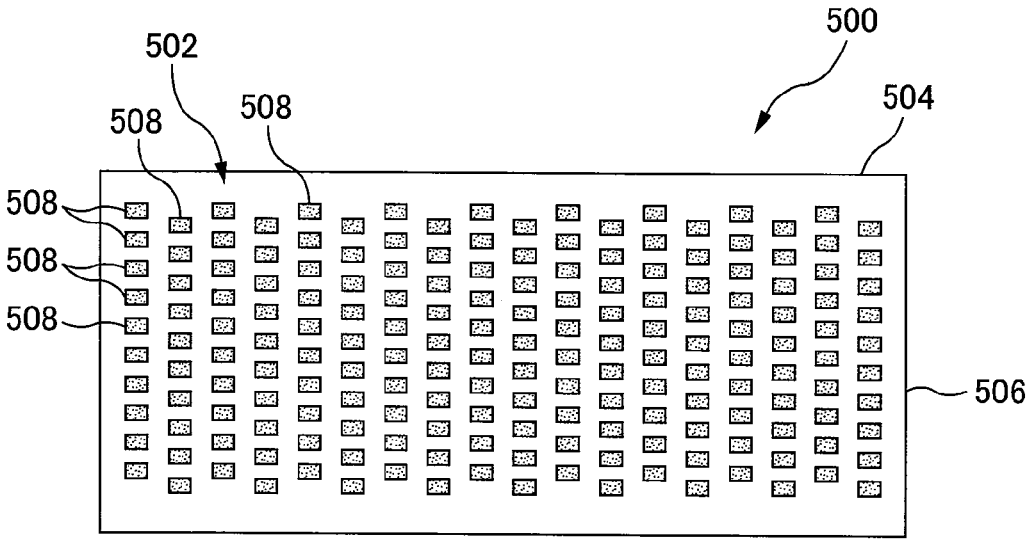
FIG. 15 is a diagram showing an example of a clear-ink test pattern.
Figure 16:
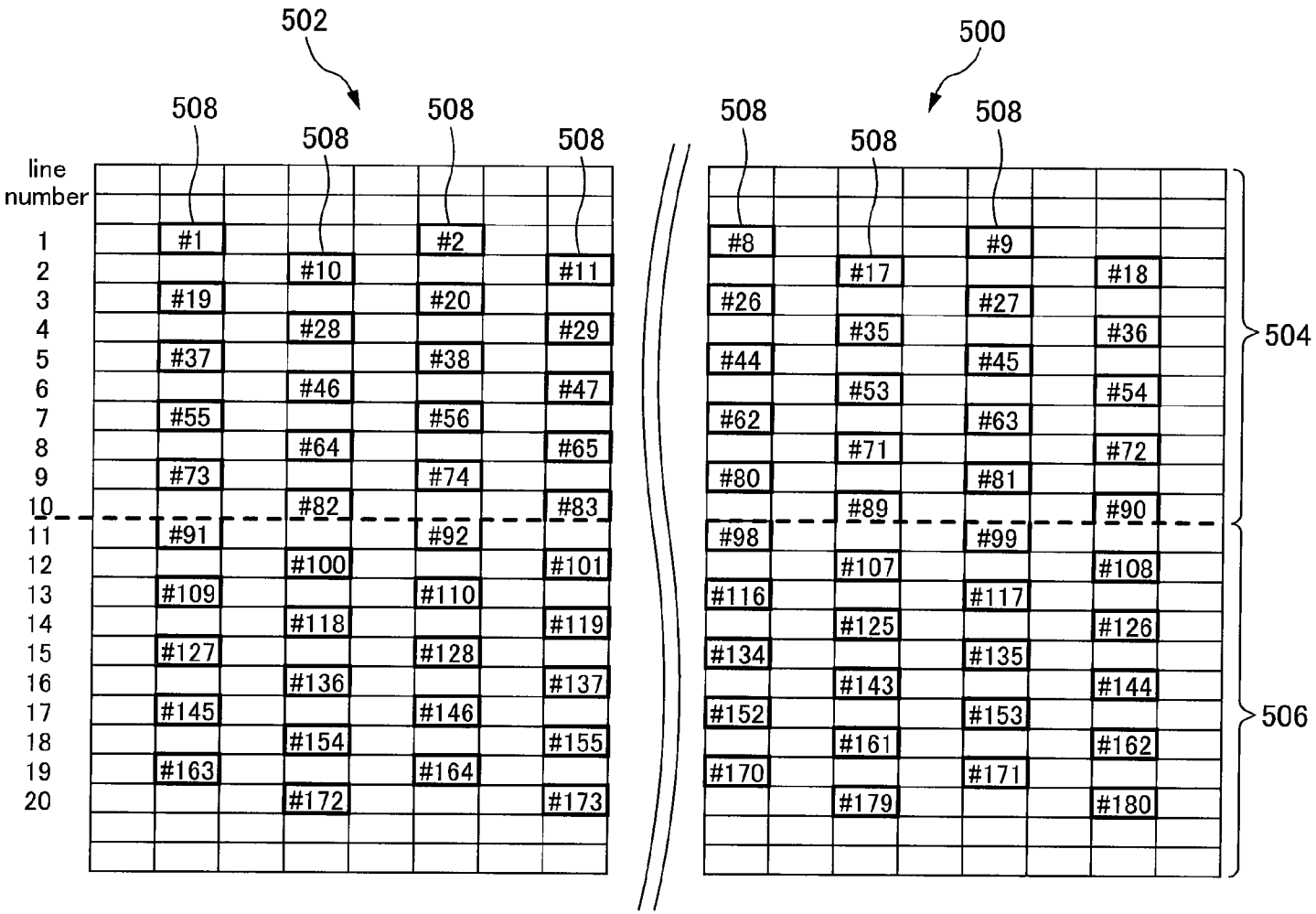
FIG. 16 is an enlarged, detailed diagram of the clear-ink test pattern.
Figure 17:
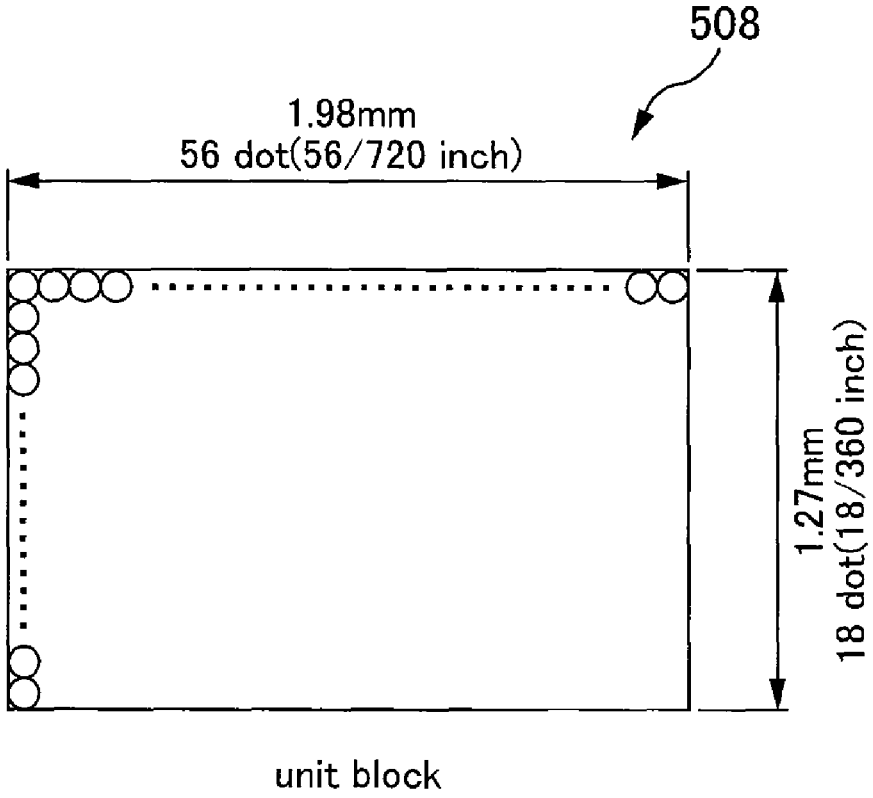
FIG. 17 is a detailed diagram of a block-shaped pattern.

FIG. 15 shows one embodiment of a clear-ink test pattern. Furthermore, FIG. 16 shows an enlarged and detailed view of the clear-ink test pattern 500. FIG. 17 is a detailed view of one block-shaped pattern formed in the clear-ink test pattern 500.

As shown in FIG. 15, the test pattern 500 is made of two kinds of patterns: a clear-ink pattern 502 formed by the ejection of clear ink, and color-ink patterns 504 and 506 formed by the ejection of color ink. The clear-ink pattern 502 is constituted by a multitude of block-shaped patterns 508. As shown in FIG. 16, the block-shaped patterns 508 are respectively formed such that they correspond to one of the nozzles #1 to #180 that eject clear ink. That is, a single block-shaped pattern 508 is formed for a single nozzle that ejects clear ink. Each block-shaped pattern 508 is formed by the adherence of only clear ink ejected from the corresponding nozzle. As shown in FIG. 17, a single block-shaped pattern is formed in a rectangular shape with dimensions of 1.98 mm laterally (56 dots: $^{56}/_{720}$ inch) and 1.27 mm vertically (18 dots: $^{18}/_{360}$ inch). In the present embodiment, the block-shaped patterns 508 are formed in 10 rows in the vertical direction of the paper face (the carrying direction of the medium) and in 18 columns in the lateral direction of the paper face (the movement direction of the carriage 41) with a spacing provided between one another.

On the other hand, the color-ink patterns 504 and 506 are formed overlapping the clear-ink pattern 502. In the present embodiment, the color-ink patterns 504 and 506 are structured as two patterns, an upper portion pattern 504 and a lower portion pattern 506, and are formed in a rectangular shape such that the entire clear-ink pattern 502 is covered as shown in the drawing. In the present embodiment, cyan (C) is used as the color ink for forming the color-ink patterns 504 and 506, and the color-ink patterns 504 and 506 are formed at a resolution of 180 dpi (lateral)×360 dpi (vertical). Alternatively, except for yellow (Y), which is the lightest color, other color inks such as magenta (M), matte black (MBk), photo black (PBk), red (R), and violet (V) may be used as the color ink that forms the color-ink patterns 504 and 506 in the present embodiment.

It should be noted that, since the printer 1 is provided with color inks of the colors yellow (Y), magenta (M), cyan (C), matte black (MBk), photo black (PBk), red (R), and violet (V) as color inks to be used in printing in the present embodiment, it is possible to use color inks of colors other than the lightest color, yellow (Y), to form the color-ink patterns 504 and 506, but when color inks of another combination are loaded in the printer 1, the color ink to be used in forming the color-ink patterns 504 and 506 should be selected as appropriate according to the individual combination. In other words, if the printer 1 is provided with, for example, cyan (C), magenta (M), black (Bk), light cyan (LC), light magenta (LM), and dark yellow (DY) as a combination of color inks, then light cyan (LC) and light magenta (LM) should be picked out as color inks not to be used in forming the color-ink patterns 504 and 506, and a selection should be made as appropriate from the other color inks aside from light cyan and light magenta, namely, from cyan (C), magenta (M), black (Bk), and dark yellow (DY).

<Reason for Forming Color-Ink Patterns>

The reason why the color-ink patterns 504 and 506 are formed overlapping the clear-ink pattern 502 is as follows. When the clear-ink pattern 502 and the color-ink patterns 504 and 506 are formed overlapping one another, the region in which the patterns 502, 504, and 506 of both inks overlap has a different color from the section in which only the color ink has adhered, as shown in FIG. 15 and FIG. 16. This is thought to occur because both inks blur when the clear ink and the color ink adhere to the same region. That is, blurring of the clear ink and the color ink causes the color ink to spread over the medium. When the color ink is formed on the medium as a dot, then the color of the base, that is, the white color of the medium, will appear on the outside from the space between the dots, thereby causing the color to look light. On the other hand, when the color ink blurs with the clear ink and spreads over the medium, the color ink covers the surface of the medium and thus the base color, that is, the white color of the medium does not appear to the outside, thereby causing the color to not look so light.

Particularly, it is possible to further prevent blurring of the clear ink and the color ink by firing the clear ink onto the medium first and then firing the color ink onto the region on which the clear ink has been fired first. This is thought to occur because by first firing the clear ink onto the medium, the surface of the medium can be soaked with the clear ink, and the color ink that is fired thereon afterwards immediately blurs to thereby spread over a large area. In this way, it is possible to make the difference in color more clear.

Of course, it is also possible to cause blurring of the color ink and the clear ink by first firing the color ink and then firing the clear ink afterwards. However, there is a possibility that the difference in color will not appear so much because many kinds of the color ink fired first set onto the medium such as by permeation, and therefore, the color ink does not blur with the clear ink even when the clear ink is fired afterwards. In particular, glossy paper or the like, which is different from normal paper, has a setting layer formed thereon for setting the ink onto its surface. Therefore, if the color ink is fired first, then the color ink sets onto the medium and does not blur so much even when the clear ink is fired afterwards. When giving consideration to the assumption that the testing is going to be carried out by a user, it is preferable to employ a method capable of generally forming a test pattern on various media such as plain paper and glossy paper, that is, to employ a method of first firing the clear ink and then firing the color ink, because it is uncertain whether plain paper or glossy paper will be used as the medium for forming the test pattern.

<Procedure for Forming Test Patterns>

The following is a description of a method for forming the test pattern 500.

It should be noted that the test pattern 500 is formed by the system controller (controller) 126 provided in the inkjet printer 1 controlling ink ejection of the clear-ink nozzle 212 and the color-ink nozzles 211. Further, the system controller (controller) 126 controls formation of the test pattern 500 in accordance with codes stored in a computer-readable medium (main memory 127, EEPROM 129, etc.).

Figure 18A:
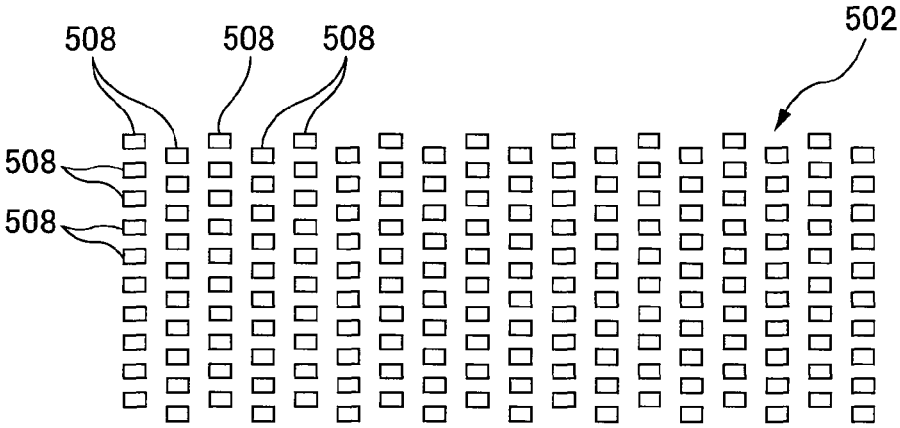
FIG. 18A is a first explanatory diagram of a procedure for forming a clear-ink test pattern.
Figure 18B:
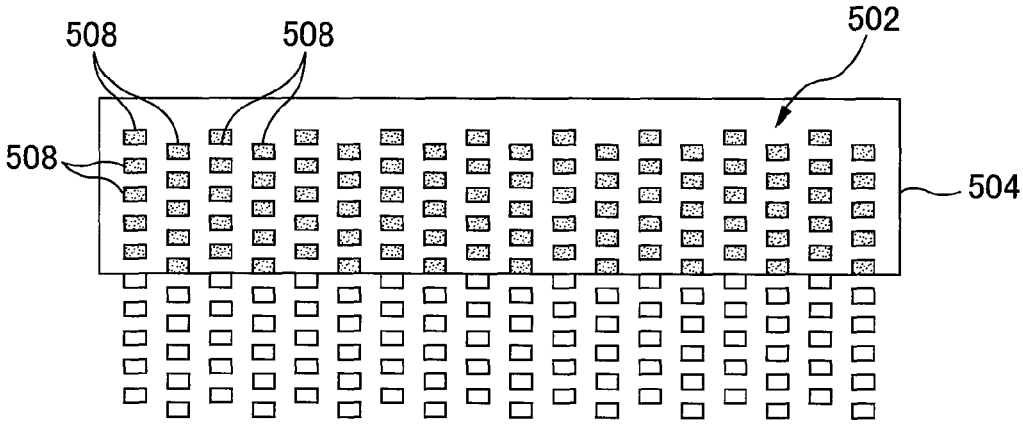
FIG. 18B is a second explanatory diagram of a procedure for forming a clear-ink test pattern.
Figure 18C:
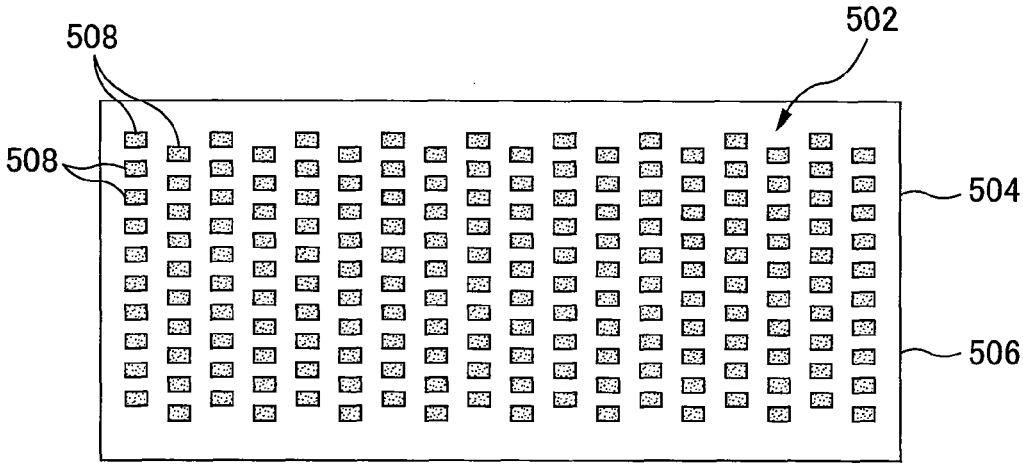
FIG. 18C is a third explanatory diagram of a procedure for forming a clear-ink test pattern.

FIG. 18A to FIG. 18C show an example of a procedure for forming a clear-ink test pattern 500. In forming the clear-ink test pattern 500, first, as described above, clear ink is ejected onto the medium as shown in FIG. 18A to form a clear-ink pattern 502 made of block-shaped patterns 508 for individual nozzles. In the present embodiment, each of the block-shaped patterns 508 is formed using the above-described "large dots". The operation in which the above-described block-shaped patterns 508 are formed with this resolution is performed a plurality of times. That is, clear ink is ejected onto the same region on the medium a plurality of times, for example, four times.

Next, color-ink patterns 504 and 506 are formed so as to cover the test pattern 502 that has been formed by ejecting clear ink. In this example, the ejection of color ink is divided into two stages. First, as shown in FIG. 18B, the color-ink upper portion pattern 504 is formed to cover the upper half of the clear-ink pattern 502. Then, as shown in FIG. 18C, the color-ink lower portion pattern 506 is formed covering the lower half of the clear-ink pattern 502. It should be noted that the forming of the color-ink upper portion pattern 504 is carried out using the nozzles #1 to #108 that eject that color ink, and the forming of the lower portion patter 506 is carried out using the nozzles #73 to #180 that eject that color ink. In the present embodiment, the upper portion pattern 504 and the lower portion pattern 506 are formed with aforementioned "large dots".

In this way, forming the color-ink patterns 504 and 506 to cover the entire clear-ink pattern 502 formed with clear ink completes the formation of the clear-ink test pattern.

===Method for Forming Color-Ink Pattern===

In the clear-ink test pattern 500 described above, if ejection failure occurs in any of the nozzles #1 to #180 of the color ink nozzle row 211 that forms the color-ink patterns 504 and 506, then the color-ink patterns 504 and 506 are not formed properly, and there is a possibility that the ejection of the clear ink cannot be inspected accurately.

In view of the above, in the printer 1 according to the present embodiment, at least two color-ink nozzles are allocated to each block-shaped pattern 508, which corresponds to each nozzle in the clear ink nozzle row 212, in order to allow the color-ink patterns 504 and 506 to be formed properly even in situations described above. To do so, in the present embodiment, formation of the color-ink patterns 504 and 506 is performed using the "interlace mode" or the "overlap mode". The "interlace mode" and the "overlap mode" are described in detail below.

<Interlace Mode>

Figure 19A:
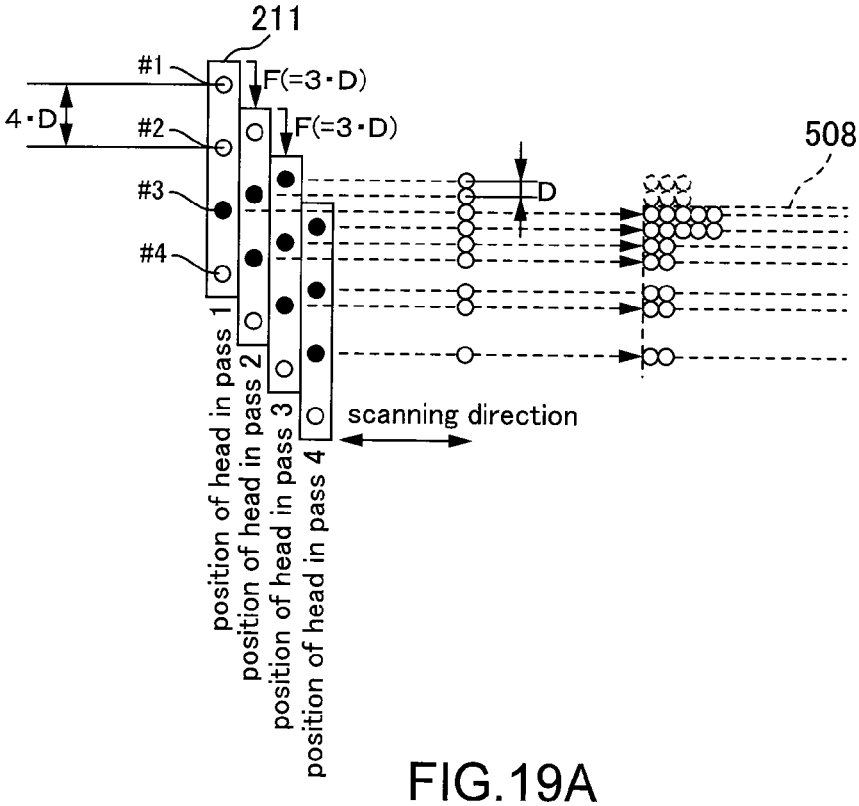
FIG. 19A is a first explanatory diagram of an example of a method for forming a color-ink pattern.
Figure 19B:
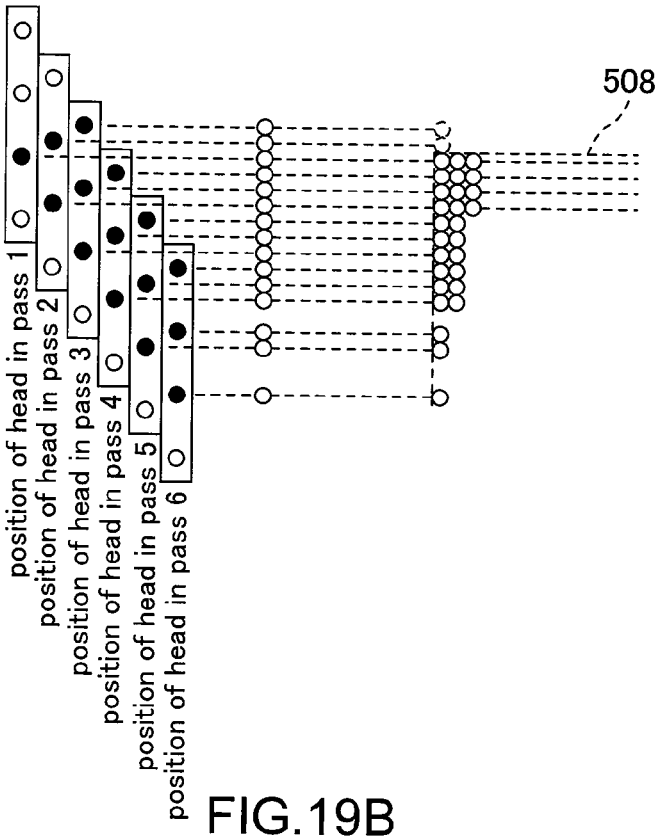
FIG. 19B is a second explanatory diagram of an example of a method for forming a color-ink pattern.

FIG. 19A and FIG. 19B schematically describe a method for forming the color-ink patterns 504 and 506 using the interlace mode. It should be noted that, for convenience of description, the nozzle row 211 (the head 21) that ejects the color ink is shown to move with respect to the medium S, but the figures show the relative positional relationship between the nozzle row 211 and the medium S, and actually, it is the medium S that moves in the carrying direction. Further, in the figures, the nozzles shown as black circles are the nozzles that are able to eject ink, and the nozzles shown as white circles are the nozzles that are not able to eject ink. FIG. 19A shows the positions of the nozzle row 211 (head 21) in pass 1 to pass 4 and how the dots are formed. FIG. 19B shows the positions of the nozzle row 211 (head 21) in pass 1 to pass 6 and how the dots are formed.

It should be noted that here, "interlace mode" refers to a print mode in which k is 2 or larger, and in which there is a non-recorded raster line between raster lines that are recorded during a single pass. Further, "pass" refers to a movement in which the nozzles move to scan once in the scanning direction (the movement direction of the carriage 41). "Raster line" refers to a row of pixels lined up in the scanning direction, and is also referred to as a scan line. Further, "pixel" refers to a squared grid on the medium S virtually set for defining the position on which an ink droplet is to land and in which a dot is to be recorded.

In the interlace mode, the nozzles record a raster line right above the raster line that has been recorded in the previous pass, every time the medium S is carried by a constant carry amount F in the carrying direction. In order to perform recording while keeping the carry amount constant, the number N (integer) of ink-ejectable nozzles is set coprime to k, and the carry amount F is set to N·D.

Here, an example in which the nozzles #1 to #4, among the nozzles #1 to #180 in a nozzle row 211, are used to form the color-ink patterns 504 and 506 is described. It should be noted that, since the nozzle pitch of the nozzle row 211 is 4 D, not all of the nozzles can be used in order to satisfy the condition, "the relation in which N and k are coprime to each other," for performing the interlace mode. Therefore, for simplicity, the example described here uses three nozzles #1 to #3 to form the color-ink patterns 504 and 506 in the interlace mode. Further, since three nozzles are used, the paper is carried by a carry amount of 3·D. As a result, for example, dots are formed on the paper at a dot interval of 720 dpi (=D) using a nozzle row 211 having a nozzle pitch of 180 dpi (4·D).

The figure shows how continuous raster lines are formed, wherein the first raster line is formed by nozzle #1 in pass 3, the second raster line is formed by nozzle #2 in pass 2, the third raster line is formed by nozzle #3 in pass 1, and the fourth raster line is formed by nozzle #1 in pass 4. It should be noted that in pass 1, only nozzle #3 ejects ink, and in pass 2, only nozzle #2 and nozzle #3 eject ink. This is because if all of the nozzles eject ink in pass 1 and pass 2, then it is not possible to form a continuous raster line on the paper. It should be noted that from pass 3 and on, three nozzles (#1 to #3) eject ink and the paper is carried by a constant carry amount F (=3·D), to form continuous raster lines at a dot interval D.

In this way, as shown on the right side of FIG. 19A and FIG. 19B, the block-shaped pattern 508 for each nozzle #1 to #180 of the clear ink nozzle row 212 is made of a plurality of dots that are formed with color ink ejected from at least two nozzles. In this way, even if there is ejection failure in some of the color-ink nozzles #1 to #180, it is possible to avoid a situation in which the color-ink patterns 504 and 506 are not formed properly. Thus, it is possible to accurately inspect the ejection of the clear ink.

Figure 20A:
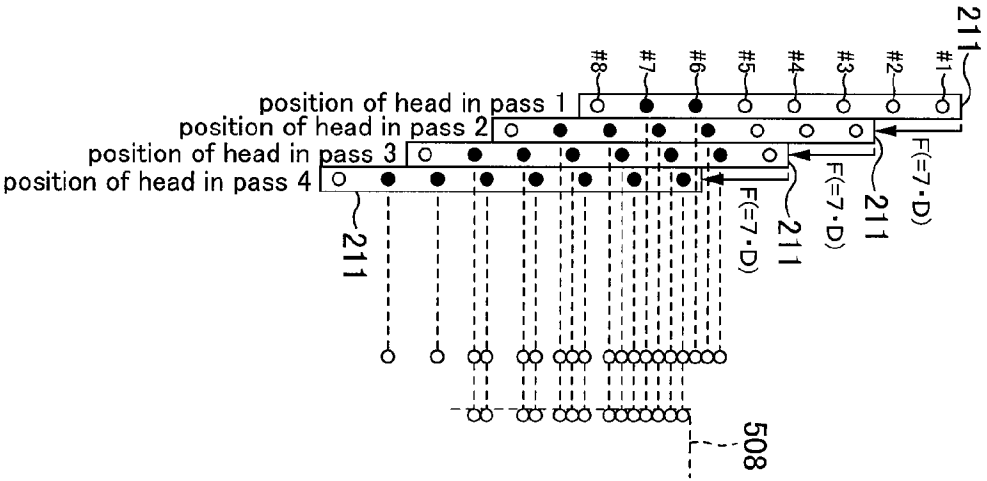
FIG. 20A is a first explanatory diagram of another example of a method for forming a color-ink pattern.
Figure 20B:
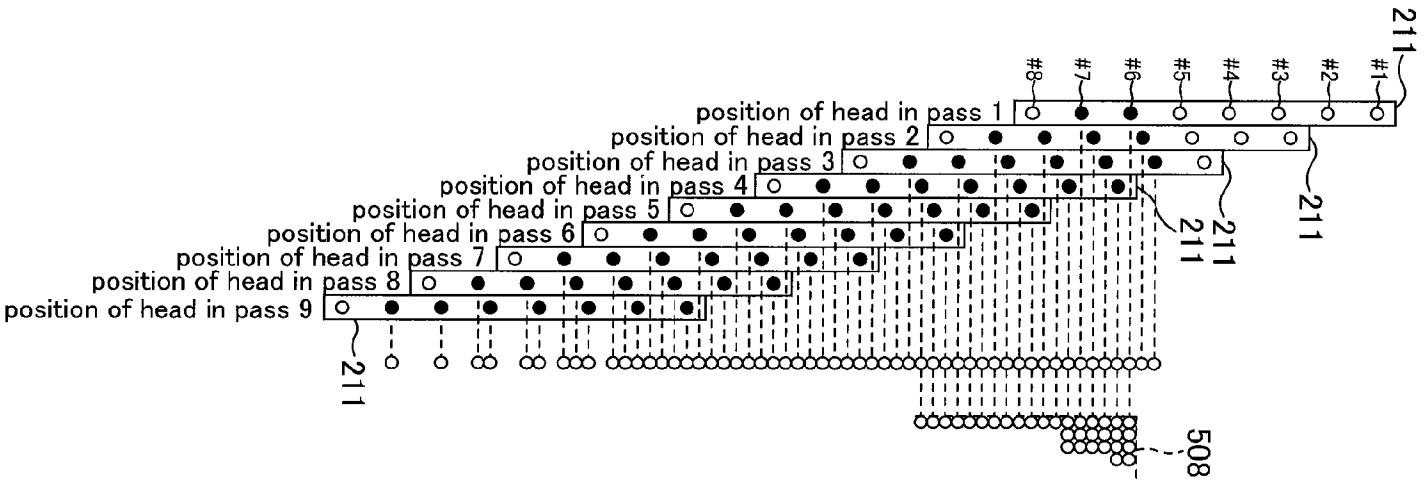
FIG. 20B is a second explanatory diagram of another example of a method for forming a color-ink pattern.

FIG. 20A and FIG. 20B describe another method regarding the interlace mode. Here, the number of nozzles used is different. The nozzle pitch etc. is the same as that of the explanatory diagrams described above, so description thereof is omitted. FIG. 20A shows the positions of the nozzle row 211 in pass 1 to pass 4 and how the dots are formed, and FIG. 20B shows the positions of the nozzle row 211 in pass 1 to pass 9 and how the dots are formed.

In the figures, an example in which the nozzles #1 to #8, among the nozzles #1 to #180 in a nozzle row 211, are used to form the color-ink patterns 504 and 506 is described. Here, since the nozzle pitch of the nozzle row is 4 D, not all of the nozzles can be used in order to satisfy the condition, "the relation in which N and k are coprime to each other," for performing the interlace mode. Therefore, for simplicity, the example described here uses seven nozzles #1 to #7 to perform the interlace mode. Since the seven nozzles #1 to #7 are used, the paper carry amount is set to 7·D.

The figure shows how continuous raster lines are formed, wherein the first raster line is formed by nozzle #2 in pass 3, the second raster line is formed by nozzle #4 in pass 2, the third raster line is formed by nozzle #6 in pass 1, and the fourth raster line is formed by nozzle #1 in pass 4. It should be noted that from pass 3 and on, seven nozzles (#1 to #7) eject ink and the paper is carried by a constant carry amount F (=7·D), to form continuous raster lines at a dot interval D.

Here, the number of nozzles used for ejecting the color ink is larger, compared to the interlace mode described previously. Thus, the number N of ink-ejectable nozzles becomes larger, and therefore, the carry amount F for a single carry becomes larger, resulting in faster printing speed. As described above, by increasing the number of ink-ejectable nozzles when performing the interlace mode, the printing speed becomes faster, which is more advantageous.

<Overlap Mode>

Figure 21A:
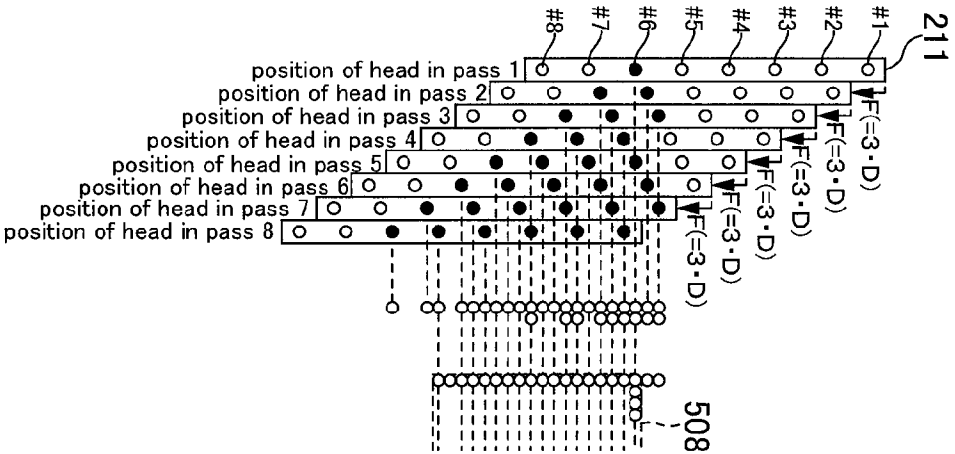
FIG. 21A is a third explanatory diagram of another example of a method for forming a color-ink pattern.
Figure 21B:
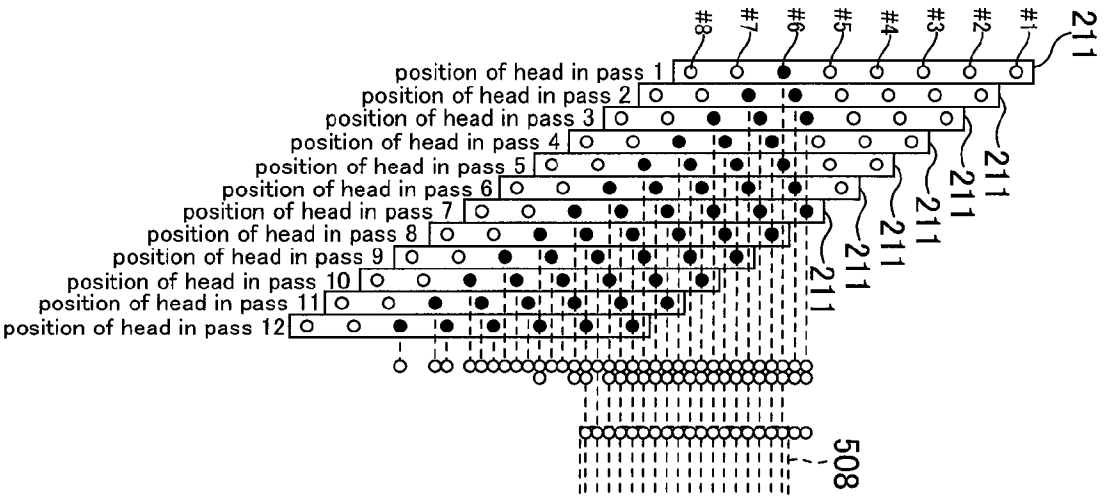
FIG. 21B is a fourth explanatory diagram of another example of a method for forming a color-ink pattern.

FIG. 21A and FIG. 21B schematically describe a method for forming the color-ink patterns 504 and 506 using the overlap mode. FIG. 21A shows the positions of the nozzle row 211 in pass 1 to pass 8 and how the dots are formed, and FIG. 21B shows the positions of the nozzle row 211 in pass 1 to pass 12 and how the dots are formed. In the interlace mode described above, one raster line was formed using one nozzle. On the other hand, in the overlap mode, one raster line is formed, for example, by at least two nozzles.

In the overlap mode, each nozzle forms dots intermittently at intervals of several dots, every time the paper is carried by a constant carry amount F in the carrying direction. In another pass, a different nozzle forms dots such as to complement the intermittent dots that have already formed, thereby completing a single raster line using a plurality of nozzles. When a single raster line is completed in M passes, this is defined as "overlap number M" herein. In the figures, since each nozzle intermittently forms dots at an interval of every other dot, dots are formed in either the odd-numbered pixels or the even-numbered pixels in each pass. Since a single raster line is formed by two nozzles, the overlap number M is 2. It should be noted that as for the interlace mode described above, the overlap number M is 1.

The conditions for performing recording at a constant carry amount using the overlap mode are as follows:

(1) N/M is an integer;

(2) N/M is coprime to k; and (3) the carry amount F is set to (N/M)·D.

In the figures, the number of nozzles in a nozzle row 211 is 180. However, since the nozzle pitch of the nozzle row 211 is 4 D (k=4), not all of the nozzles can be used in order to satisfy the condition, "the relation in which N/M and k are coprime to each other," for performing printing with the overlap mode. Therefore, for simplicity, the example described here uses nozzles #1 to #6, among the nozzles #1 to #180 in a nozzle row 211, to form the color-ink patterns 504 and 506. Since six nozzles are used, the paper is carried by a carry amount of 3·D. As a result, for example, dots are formed on the paper at a dot interval of 720 dpi (=D) using a nozzle group having a nozzle pitch of 180 dpi (4·D). Further, in a single pass, each nozzle intermittently forms dots at an interval of every other dot in the scanning direction. In the figures, a raster line in which two dots are depicted in the scanning direction is already complete. For example, in FIG. 21A, the first sixth raster lines are already complete. A raster line in which one dot is depicted is a raster line in which dots are intermittently formed at an interval of every other dot. For example, the seventh and the tenth raster lines have dots intermittently formed at an interval of every other dot. It should be noted that the seventh raster line in which dots are intermittently formed at an interval of every other dot will be completed by forming dots with nozzle #1 in pass 9 in a complementary manner.

The figure shows how continuous raster lines are formed, wherein the first raster line is formed by nozzle #4 in pass 3 and nozzle #1 in pass 7, the second raster line is formed by nozzle #5 in pass 2 and nozzle #2 in pass 6, the third raster line is formed by nozzle #6 in pass 1 and nozzle #3 in pass 5, and the fourth raster line is formed by nozzle #4 in pass 4 and nozzle #1 in pass 8. It should be noted that in pass 1 through pass 6, there are nozzles, among nozzle #1 to nozzle #6, that do not eject ink. This is because if all of the nozzles eject ink in pass 1 through pass 6, then it is not possible to form a continuous raster line on the paper. It should be noted that from pass 7 and on, six nozzles (#1 to #6) eject ink and the paper is carried by a constant carry amount F (=3·D), to form continuous raster lines at a dot interval D.

The positions in the scanning direction at which dots are formed in each pass are shown below.

| | pass | | | | | | | |
|---|---|---|---|---|---|---|---|---|
| | 1 | 2 | 3 | 4 | 5 | 6 | 7 | 8 |
| recorded pixel | odd | even | odd | even | even | odd | even | odd |

Here, "odd" means to form a dot in an odd-numbered pixel of among the pixels lined up in the scanning direction (the pixels of a raster line). Further, "even" in the table means to form a dot in an even-numbered pixel of among the pixels lined up in the scanning direction. For example, in pass 3, the nozzles form dots in the odd-numbered pixels. When a single raster line is formed by M nozzles, then k×M passes are necessary for completing raster lines amounting to the nozzle pitch. For example, a single raster line is formed by two nozzles in the present embodiment, and therefore, 8 passes (4×2) become necessary to complete four raster lines. As appreciated from table 1, in the first four passes, the dots are formed in the order of "odd"-"even"-"odd"-"even". As a result, when the first four passes are finished, dots are formed in the even-numbered pixels in a raster line adjacent to a raster line in which dots have been formed in the odd-numbered pixels. In the latter four passes, dots are formed in the order of "even"-"odd"-"even"-"odd". That is, in the latter four passes, dots will be formed in the opposite order from the first four passes. As a result, dots are formed such as to complement the spaces between the dots formed in the first-half passes.

In the overlap mode, as in the interlace mode described above, if the number N of ink-ejectable nozzles becomes larger, then the carry amount F for a single carry becomes larger, resulting in faster printing speed. Therefore, by increasing the number of ink-ejectable nozzles when performing the overlap mode, the printing speed becomes faster, which is more advantageous.

As described above, by applying the "interlace mode" or the "overlap mode" when forming the color-ink patterns 504 and 506, it is possible to easily allocate two or more color-ink nozzles to each block-shaped pattern 508 that corresponds to each nozzle in the clear ink nozzle row. Therefore, even if there is ejection failure in a color-ink nozzle, the color ink can be ejected from other color-ink nozzles to form the test pattern 508 for each clear-ink nozzle, and thus, it becomes possible to inspect the ejection of the clear ink accurately.

It should be noted that in the present invention, the color-ink patterns 504 and 506 may be formed using methods other than the "interlace mode" or the "overlap mode".

===Method for Checking Test Patterns===

The following is a description of a method for checking the test patterns 400 and 500. Checking of the test patterns 400 and 500 is carried out using the reflective optical sensor 300 provided on the carriage 41. The reflective optical sensor 300 is arranged above the test patterns 400 and 500 and checks the block-shaped patterns 412 and 508 formed in the test patterns 400 and 500 line by line by moving relative to the medium S with the movement of the carriage 41. At this time, light is emitted toward the medium S from the light-emitting section 300A of the reflective optical sensor 300, and the emitted light is reflected by the medium S and received by the light-receiving section 300B. The reflective optical sensor 300 outputs the amount of light received by the light-receiving section 300B to the system controller 126.

Based on the result of light received from the reflective optical sensor 300, the system controller 126 checks the nozzles individually for whether or not there is an ejection failure. Specifically, the system controller 126 compares the amount of light received by the light-receiving section 300B of the reflective optical sensor 300 with a predetermined threshold value that is stored in advance in the main memory 127 etc., and determines whether or not there is an ejection failure. When one line of the checking is finished, the medium is carried by the carrying section and checking with respect to the next line is carried out. In this way, whether or not there is an ejection failure is checked successively using the test patterns 400 and 500. It should be noted that the system controller 126 corresponds to the checking means in the present invention.

===Nozzle Cleaning===

Below are types of nozzle cleaning carried out when it is determined, as a result of testing ejection, that there is ejection failure in a nozzle.

<Nozzle Suction>

This is a method carried out using the cleaning device described in FIG. 2. Specifically, ink is forcefully sucked out from the nozzle by the above-described pump device 31 to eliminate the clogging or other ejection failure.

<Flushing>

Flushing is a method by which ink is forcefully ejected from the nozzles. Specifically, the piezo elements of the nozzles are driven to forcefully discharge ink from the nozzles. This eliminates the clogging or other ejection failure.

It should be noted that as regards "nozzle suction" and "flushing", it is preferable for the suction force of the pump device 31 or the ink ejection amount to be appropriately changeable, such as in a stepwise manner. In this way, it is possible to smoothly eliminate ejection failure in a nozzle by changing the suction force of the pump device 31 or the ink ejection amount in accordance with how much the ejection failure in the nozzle has been eliminated. Specifically, for example, if clogging etc. of a nozzle is not eliminated in a single nozzle cleaning process, then it is possible to perform such operation as to eliminate the ejection failure by carrying out an even intense nozzle cleaning.

Second Embodiment

The second embodiment of the present invention is described next.

The second embodiment regarding a method for forming an ejection-test pattern and a method for testing ejection will be described next.

In the second embodiment, when forming an ejection-test pattern, a first test pattern 2400 that is used for inspecting ejection of a color-ink nozzle 211 is formed on a medium by ejecting a color ink from the color-ink nozzle 211;

the ejection of the color-ink nozzle 211 is inspected using the first test pattern 2400; and after inspecting the ejection of the color-ink nozzle 211, a second test pattern 2500 that is used for inspecting ejection of a clear-ink nozzle 212 is formed on a medium, the second test pattern 2500 being made using the color ink ejected from the color-ink nozzle 211 and a clear ink ejected from the clear-ink nozzle 212.

Further, ejection testing is performed using the ejection-test pattern that has been formed in this way.

Further, a system controller (controller) 126 provided in the inkjet printer 1 controls ejection of ink from the clear-ink nozzle 212 and the color-ink nozzle 211. In order to form an ejection-test pattern, the system controller 126 causes a first test pattern 2400 that is used for inspecting ejection of the color-ink nozzle 211 to be formed on a medium by ejecting the color ink from the color-ink nozzle 211; causes the ejection of the color-ink nozzle 211 to be inspected using the first test pattern 2400; and after inspecting the ejection of the color-ink nozzle 211, causes a second test pattern 2500 that is used for inspecting ejection of the clear-ink nozzle 212 to be formed on a medium, the second test pattern 2500 being made using the color ink ejected from the color-ink nozzle 211 and the clear ink ejected from the clear-ink nozzle 212.

Further, a computer-readable medium (main memory 127, EEPROM 129, etc.) stores the following codes: a code for causing a first test pattern 2400 that is used for inspecting ejection of a color-ink nozzle 211 to be formed on a medium by ejecting a color ink from the color-ink nozzle 211; a code for causing the ejection of the color-ink nozzle 211 to be inspected using the first test pattern 2400; and a code for causing a second test pattern 2500 that is used for inspecting ejection of a clear-ink nozzle 212 to be formed on a medium after inspecting the ejection of the color-ink nozzle 211, the second test pattern 2500 being made using the color ink ejected from the color-ink nozzle 211 and a clear ink ejected from the clear-ink nozzle 212.

This is described in detail below.

===Color Ink Test Pattern===

The color-ink test pattern formed by the printer 1 according to the present embodiment is described next.

Figure 22:
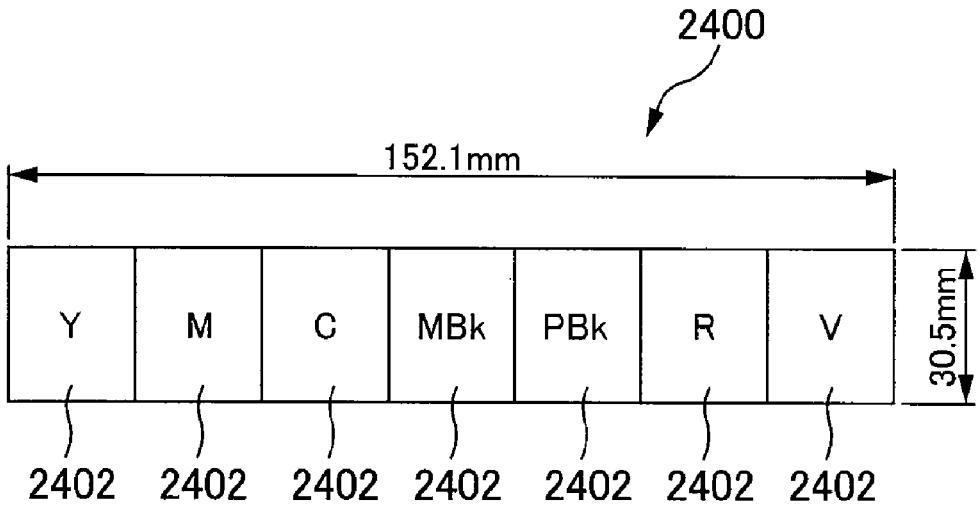
FIG. 22 is a diagram showing one example of a color-ink test pattern according to a second embodiment.

FIG. 22 shows an overview of a test pattern (first test pattern) 2400 used for testing ejection of each of the nozzles #1 to #180 of the color ink nozzle rows 211 for each color. As shown in FIG. 22, the test pattern 2400 is constituted by rectangular patterns 2402 formed by the respective color inks of the colors yellow (Y), magenta (M), cyan (C), matte black (MBk), photo black (PBk), red (R), and violet (V). In the present embodiment, the color block-shaped patterns 2402 are formed and arranged lined up laterally in a row along the movement direction of the carriage 41, as shown in the figure. In the pattern 2402 for each color, block-shaped patterns are formed corresponding to each of the nozzles #1 to #180 for each color.

Figure 23:
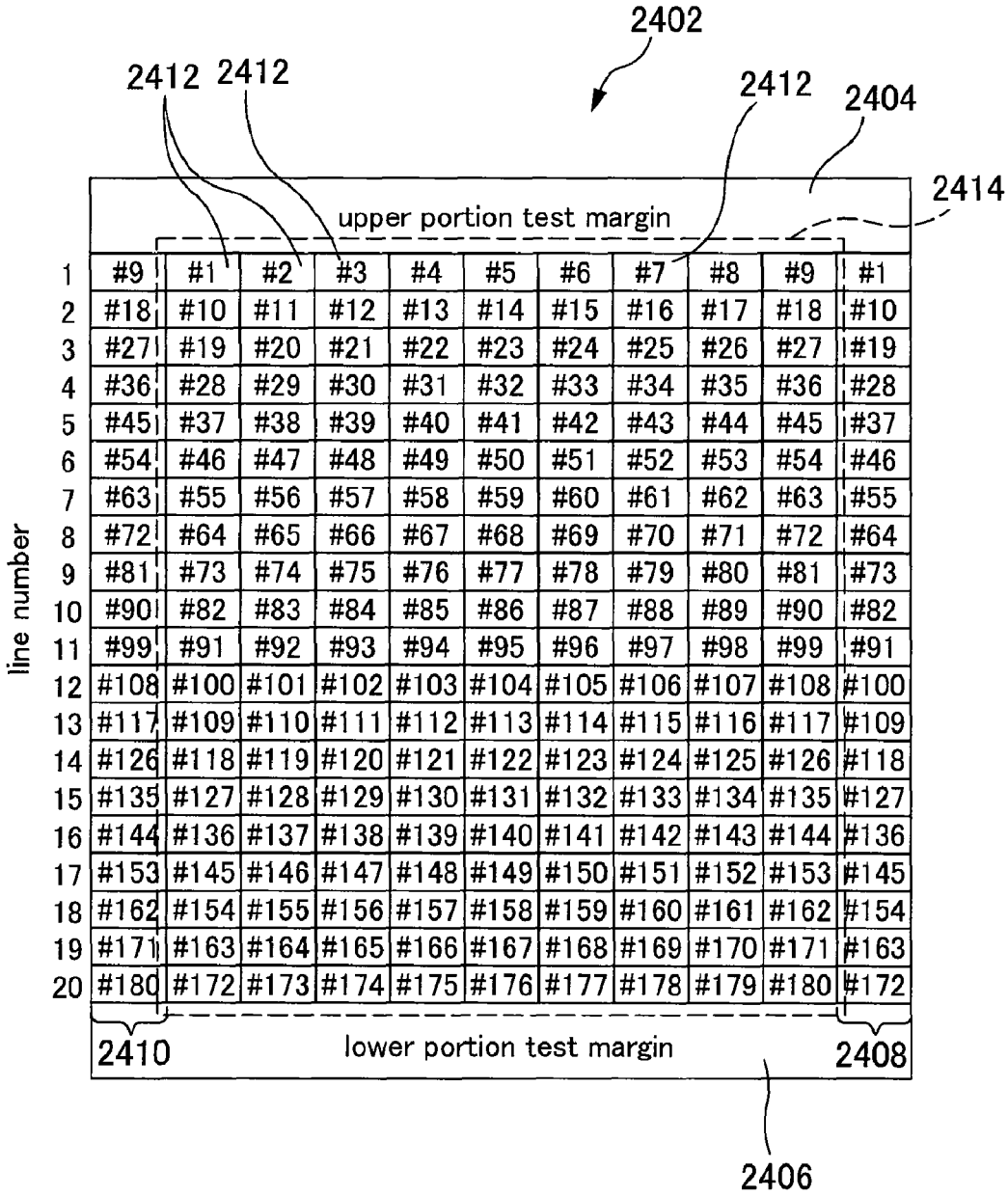
FIG. 23 is a detailed diagram of the test pattern of a given color according to the second embodiment.

FIG. 23 describes an enlarged and detailed view of the configuration of each of the block-shaped patterns 2402. As shown in FIG. 23, in the respective upper, lower, left, and right side portions of the pattern 2402 are provided an upper portion test margin 2404, a lower portion test margin 2406, a right portion test margin 2408, and a left portion test margin 2410, and further, a test pattern group 2414 for the individual nozzles including a plurality of block-shaped test patterns 2412 is provided so as to be enclosed within the test margins 2404, 2406, 2408, and 2410. The upper portion test margin 2404 is formed with color ink ejected from the nozzles #1 to 8 and #10 to #17 of the color ink nozzle row 211 for each color, and the lower portion test margin 2406 is formed with color ink ejected from the nozzles #163 to #170 and #172 to #179 of the color ink nozzle row 211 for each color. Further, the right portion test margin 2408 and the left portion test margin 2410 are formed, respectively, with color ink ejected from the nozzles of the color ink nozzle row 211 for each color that correspond to the nozzle numbers (#1 to #180) shown in the figure.

On the other hand, each of the test patterns 2412 formed in the test pattern group 2414 for the individual nozzles is formed with color ink ejected from a nozzle of the color ink nozzle row 211 for each color that corresponds to the nozzle number (#1 to #180) shown in the figure. In other words, one test pattern 2412 is allocated to each nozzle in the color ink nozzle row 211 for each color, and each block-shaped pattern 2412 is formed only by the color ink ejected from the nozzle that corresponds thereto. That is, test patterns 2412 corresponding to all of the nozzles #1 to #180 of a certain nozzle row 211 are formed in the test pattern group 2414 for the individual nozzles. In the present embodiment, 20 rows of these block-shaped test patterns 2412 are formed in the vertical direction of the paper face (the carrying direction of the medium S), and 9 columns of them are formed in the lateral direction of the paper face (the movement direction of the carriage 41); a total of 180 patterns, that is, patterns amounting to the number of nozzles #1 to #180 are provided.

Figure 24:
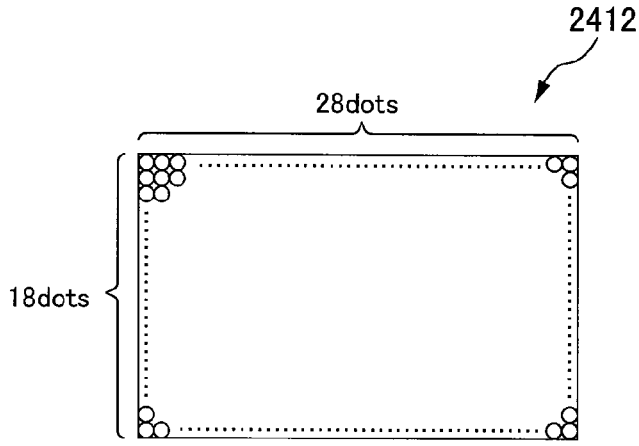
FIG. 24 is a detailed diagram of a pattern for each nozzle according to the second embodiment.

FIG. 24 describes in detail a single block-shaped test pattern 2412 formed in the test pattern group 2414 for the individual nozzles. As shown in the figure, a single test pattern 2412 for each nozzle is constituted of a multitude of dots formed by the color ink, which has been ejected from the color-ink nozzles for each color, adhering to the medium S. The dots are formed with appropriate intervals therebetween in the lateral direction of the paper face (the movement direction of the carriage 41) and the vertical direction of the paper face (the carrying direction of the medium S). Here, in each test pattern 2412, a total of 504 dots—28 dots in the lateral direction of the paper face (the movement direction of the carriage 41) and 18 dots in the vertical direction of the paper face (the carrying direction of the medium S)—are formed. In the present embodiment, large-sized ink droplets are ejected from each of the nozzles #1 to #180 of the color ink nozzle row 211 for each color, and each dot is formed as a large-sized dot (large dot).

===Clear Ink Test Pattern===

<Test Pattern>

Figure 25:
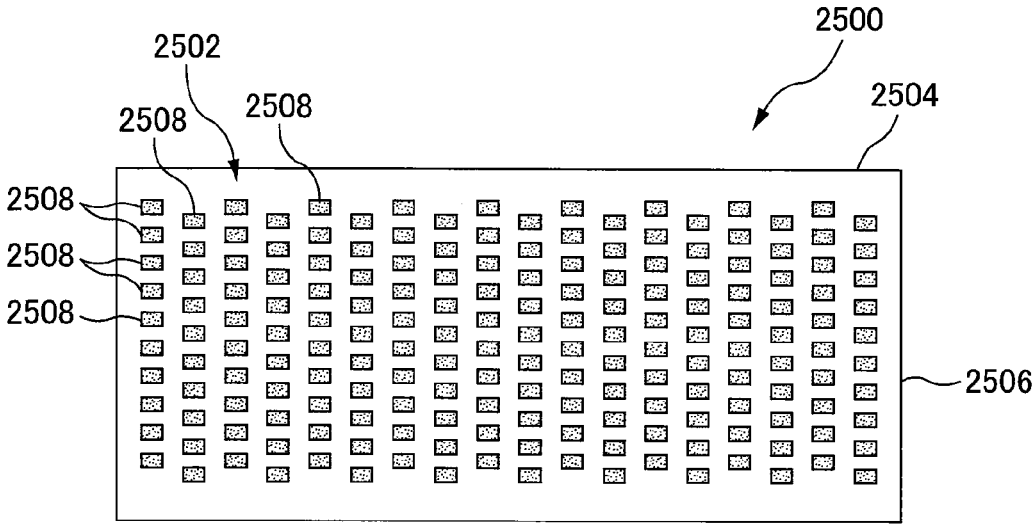
FIG. 25 is a diagram showing an example of a clear-ink test pattern according to the second embodiment.
Figure 26:
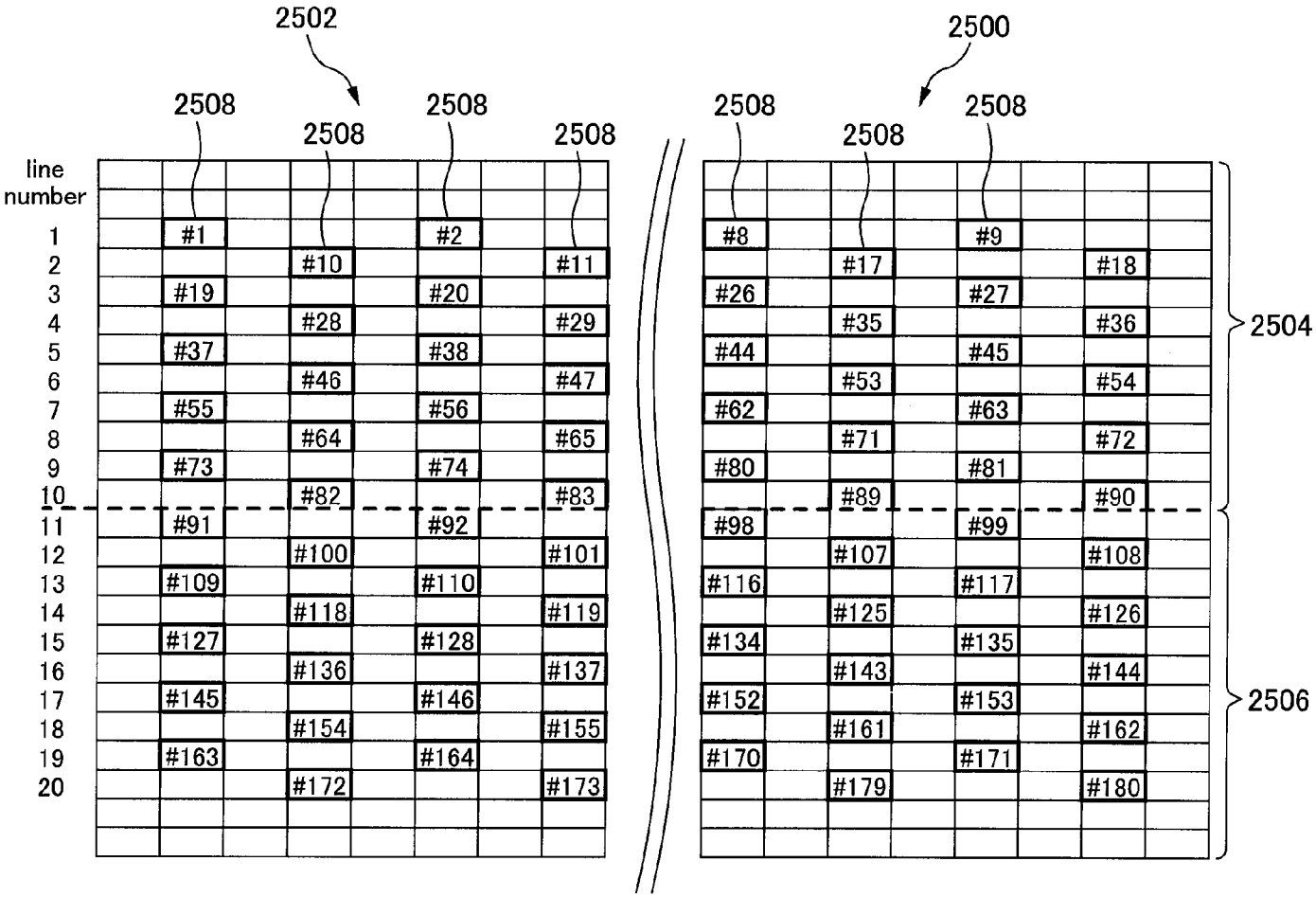
FIG. 26 is an enlarged, detailed diagram of the clear-ink test pattern according to the second embodiment.
Figure 27:
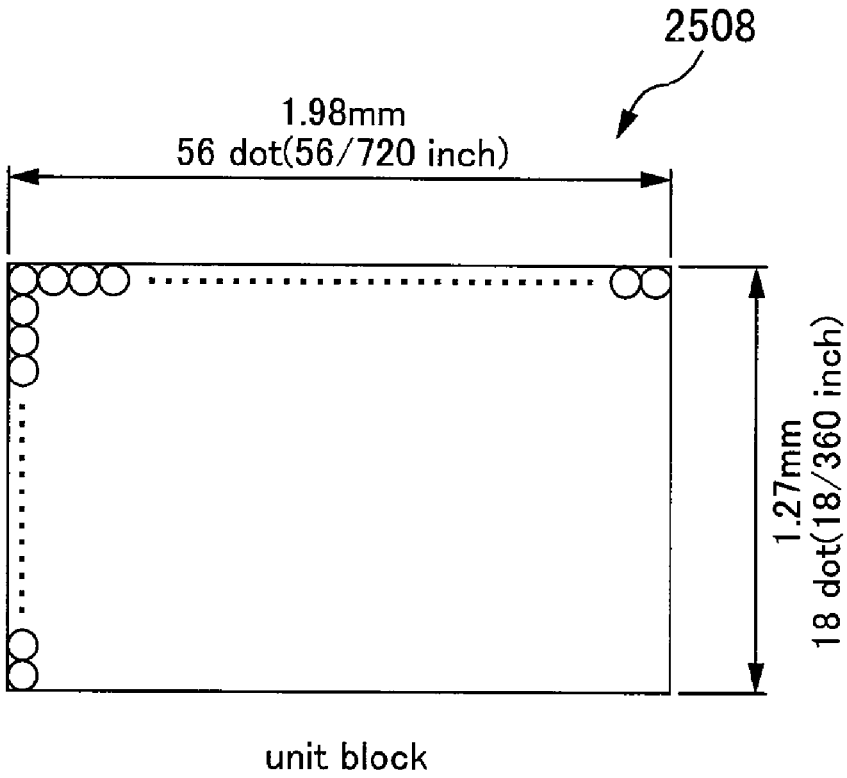
FIG. 27 is a detailed diagram of a block-shaped pattern according to the second embodiment.

FIG. 25 shows one embodiment of a clear-ink test pattern (second test pattern) 2500. Furthermore, FIG. 26 shows an enlarged and detailed view of the clear-ink test pattern 2500. FIG. 27 is a detailed view of one block-shaped pattern formed in the clear-ink test pattern 2500.

As shown in FIG. 25, the test pattern 2500 is made of two kinds of patterns: a clear-ink pattern 2502 formed by the ejection of clear ink, and color-ink patterns 2504 and 2506 formed by the ejection of color ink. The clear-ink pattern 2502 is constituted by a multitude of block-shaped patterns 2508. As shown in FIG. 26, the block-shaped patterns 2508 are respectively formed such that they correspond to one of the nozzles #1 to #180 that eject clear ink. That is, a single block-shaped pattern 2508 is formed for a single nozzle that ejects clear ink. Each block-shaped pattern 2508 is formed by the adherence of only clear ink ejected from the corresponding nozzle. As shown in FIG. 27, a single block-shaped pattern is formed in a rectangular shape with dimensions of 1.98 mm laterally (56 dots: $^{56}/_{720}$ inch) and 1.27 mm vertically (18 dots: $^{18}/_{360}$ inch). In the present embodiment, the block-shaped patterns 2508 are formed in 10 rows in the vertical direction of the paper face (the carrying direction of the medium) and in 18 columns in the lateral direction of the paper face (the movement direction of the carriage 41) with a spacing provided between one another.

On the other hand, the color-ink patterns 2504 and 2506 are formed overlapping the clear-ink pattern 2502. In the present embodiment, the color-ink patterns 2504 and 2506 are structured as two patterns, an upper portion pattern 2504 and a lower portion pattern 2506, and are formed in a rectangular shape such that the entire clear-ink pattern 2502 is covered as shown in the drawing. In the present embodiment, cyan (C) is used as the color ink for forming the color-ink patterns 2504 and 2506, and the color-ink patterns 2504 and 2506 are formed at a resolution of 180 dpi (lateral)×360 dpi (vertical). Alternatively, except for yellow (Y), which is the lightest color, other color inks such as magenta (M), matte black (MBk), photo black (PBk), red (R), and violet (V) may be used as the color ink that forms the color-ink patterns 2504 and 2506 in the present embodiment.

It should be noted that, since the printer 1 is provided with color inks of the colors yellow (Y), magenta (M), cyan (C), matte black (MBk), photo black (PBk), red (R), and violet (V) as color inks to be used in printing in the present embodiment, it is possible to use color inks of colors other than the lightest color, yellow (Y), to form the color-ink patterns 2504 and 2506, but when color inks of another combination are loaded in the printer 1, the color ink to be used in forming the color-ink patterns 2504 and 2506 should be selected as appropriate according to the individual combination. In other words, if the printer 1 is provided with, for example, cyan (C), magenta (M), black (Bk), light cyan (LC), light magenta (LM), and dark yellow (DY) as a combination of color inks, then light cyan (LC) and light magenta (LM) should be picked out as color inks not to be used in forming the color-ink patterns 2504 and 2506, and a selection should be made as appropriate from the other color inks aside from light cyan and light magenta, namely, from cyan (C), magenta (M), black (Bk), and dark yellow (DY).

<Reason for Forming Color-Ink Patterns>

The reason why the color-ink patterns 2504 and 2506 are formed overlapping the clear-ink pattern 2502 is as follows. When the clear-ink pattern 2502 and the color-ink patterns 2504 and 2506 are formed overlapping one another, the region in which the patterns 2502, 2504, and 2506 of both inks overlap has a different color from the section in which only the color ink has adhered, as shown in FIG. 25 and FIG. 26. This is thought to occur because both inks blur when the clear ink and the color ink adhere to the same region. That is, blurring of the clear ink and the color ink causes the color ink to spread over the medium S. When the color ink is formed on the medium as a dot, then the color of the base, that is, the white color of the medium S, will appear on the outside from the space between the dots, thereby causing the color to look light. On the other hand, when the color ink blurs with the clear ink and spreads over the medium, the color ink covers the surface of the medium S and thus the base color, that is, the white color of the medium S does not appear to the outside, thereby causing the color to not look so light.

Particularly, it is possible to further prevent blurring of the clear ink and the color ink by firing the clear ink onto the medium S first and then firing the color ink onto the region on which the clear ink has been fired first. This is thought to occur because by first firing the clear ink onto the medium S, the surface of the medium S can be soaked with the clear ink, and the color ink that is fired thereon afterwards immediately blurs to thereby spread over a large area of the medium S. In this way, it is possible to make the difference in color more clear.

Of course, it is also possible to cause blurring of the color ink and the clear ink by first firing the color ink and then firing the clear ink afterwards. However, there is a possibility that the difference in color will not appear so much because many kinds of the color ink fired first set onto the medium S such as by permeation, and therefore, the color ink does not blur with the clear ink even when the clear ink is fired afterwards. In particular, glossy paper or the like, which is different from normal paper, has a setting layer formed thereon for setting the ink onto its surface. Therefore, if the color ink is fired first, then the color ink sets onto the medium and does not blur so much even when the clear ink is fired afterwards. When giving consideration to the assumption that the testing is going to be carried out by a user, it is preferable to employ a method capable of generally forming a test pattern 2500 on various media S such as plain paper and glossy paper, that is, to employ a method of first firing the clear ink and then firing the color ink, because it is uncertain whether plain paper or glossy paper will be used as the medium S for forming the test pattern 2500.

<Procedure for Forming Test Patterns>

The following is a description of a method for forming the test pattern 2500.

It should be noted that the test pattern 2500 etc. is formed by the system controller (controller) 126 provided in the inkjet printer 1 controlling ink ejection of the clear-ink nozzle 212 and the color-ink nozzles 211. Further, the system controller (controller) 126 controls formation of the test pattern 500 in accordance with codes stored in a computer-readable medium (main memory 127, EEPROM 129, etc.).

Figure 28A:
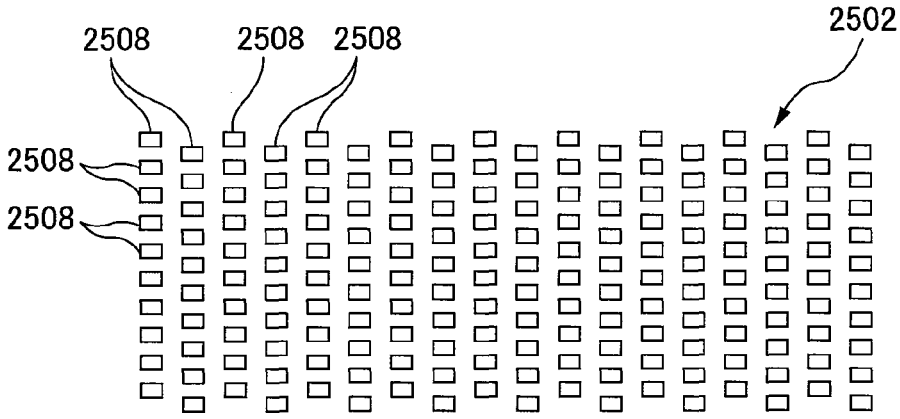
FIG. 28A is a first explanatory diagram of a procedure for forming a clear-ink test pattern according to the second embodiment.
Figure 28B:
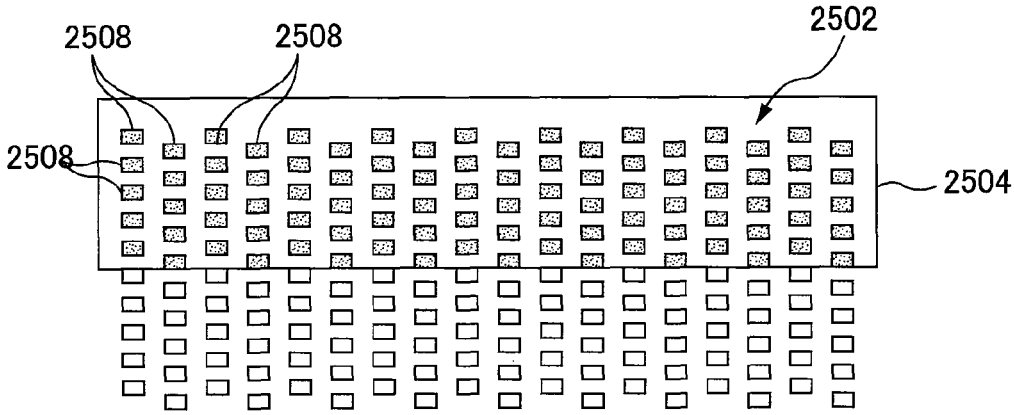
FIG. 28B is a second explanatory diagram of a procedure for forming a clear-ink test pattern according to the second embodiment.
Figure 28C:
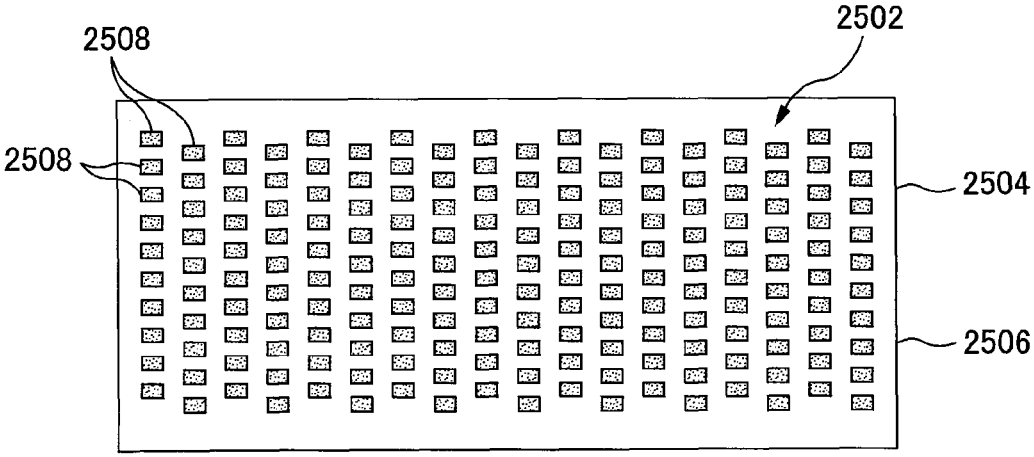
FIG. 28C is a third explanatory diagram of a procedure for forming a clear-ink test pattern according to the second embodiment.

FIG. 28A to FIG. 28C show an example of a procedure for forming a clear-ink test pattern 2500. In forming the clear-ink test pattern 2500, first, as described above, clear ink is ejected onto the medium S as shown in FIG. 28A to form a clear-ink pattern 2502 made of block-shaped patterns 2508 for individual nozzles. In the present embodiment, each of the block-shaped patterns 2508 is formed using the above-described "large dots". The operation in which the above-described block-shaped patterns 2508 are formed with this resolution is performed a plurality of times. That is, clear ink is ejected onto the same region on the medium S a plurality of times, for example, four times.

Next, color-ink patterns 2504 and 2506 are formed so as to cover the test pattern 2502 that has been formed by ejecting clear ink. In this example, the ejection of color ink is divided into two stages. First, as shown in FIG. 28B, the color-ink upper portion pattern 2504 is formed to cover the upper half of the clear-ink pattern 2502. Then, as shown in FIG. 28C, the color-ink lower portion pattern 2506 is ejected covering the lower half of the clear-ink pattern 2502, to form the pattern. It should be noted that the forming of the color-ink upper portion pattern 2504 is carried out using the nozzles #1 to #108 that eject that color ink, and the forming of the lower portion patter 2506 is carried out using the nozzles #73 to #180 that eject that color ink. In the present embodiment, the upper portion pattern 2504 and the lower portion pattern 2506 are formed with aforementioned "large dots".

In this way, forming the color-ink patterns 2504 and 2506 to cover the entire clear-ink pattern 2502 formed with clear ink completes the formation of the clear-ink test pattern 2500.

===Testing Procedure of the Present Embodiment===

In the printer 1 according to the present embodiment, ejection of the color ink and the clear ink is inspected according to the following procedure.

Figure 29:
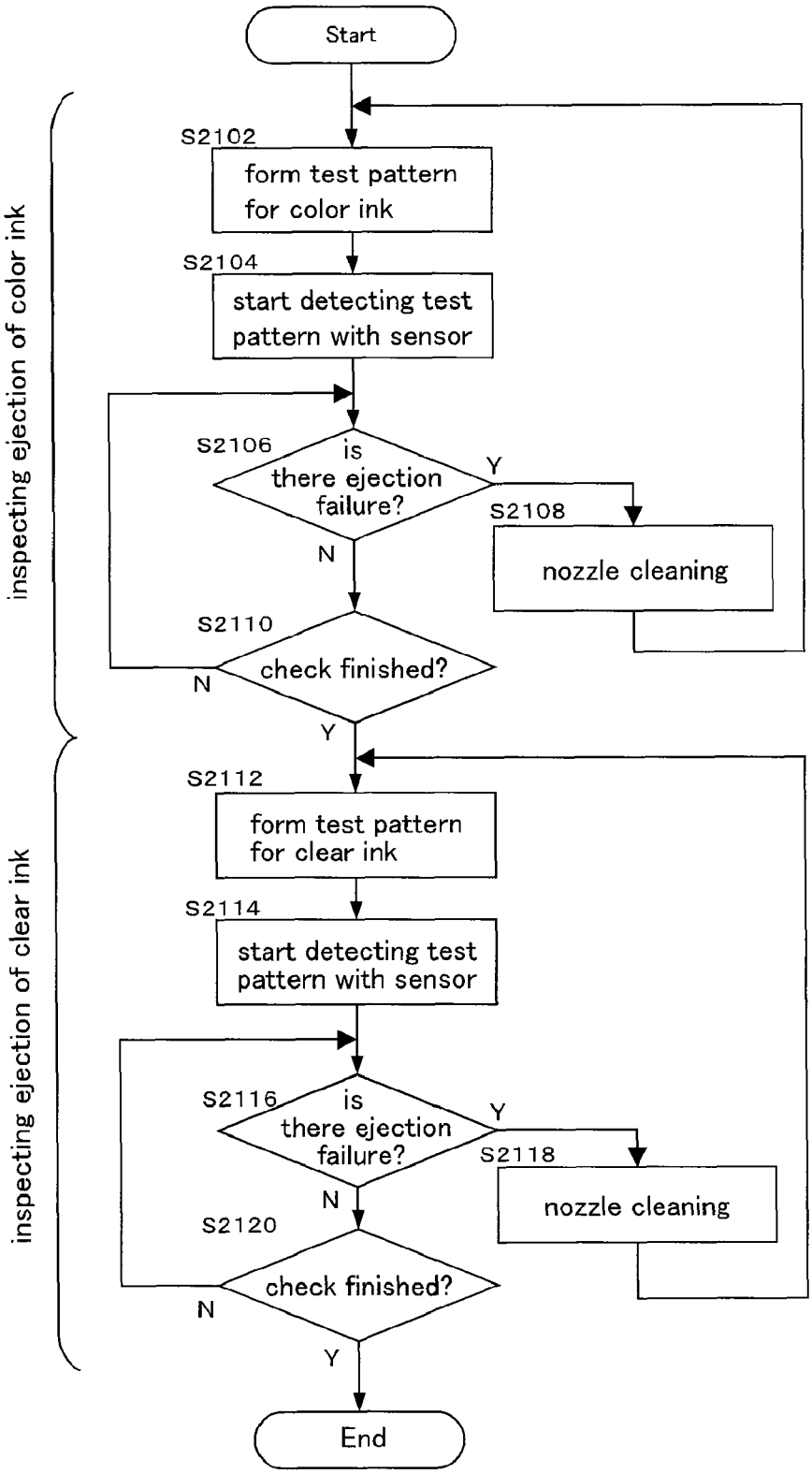
FIG. 29 is a flowchart showing an ejection testing procedure according to the second embodiment.

FIG. 29 shows an example of a procedure for inspecting the ejection of the color ink and the clear ink in the printer 1 according to the present embodiment. Here, the ejection of the color ink is inspected first, and then, the ejection of the clear ink is inspected afterwards, as shown in the figure. The reason why the ejection of the color ink is inspected before inspecting the ejection of the clear ink is as follows. As described above, the clear-ink test pattern 2500 is formed by overlapping the clear ink and the color ink over one another. Therefore, if there is ejection failure in any of the nozzles #1 to #180 of the color ink nozzle row 211, then the color ink will not be ejected properly, resulting in a situation in which it is not possible to inspect the ejection of the clear ink accurately. In view of this, the ejection of the color ink is inspected first, and if ejection failure is found as a result of the inspection, the clear-ink test pattern 2500 is formed after eliminating the ejection failure by performing nozzle cleaning.

That is, as shown in the figure, the printer 1 first forms the color-ink test pattern 2400 (S2102). Then, it starts detecting the color-ink test pattern 2400 that has been formed using the reflective optical sensor 300 provided on the carriage 41 (S2104), and based on the detection results, it checks whether or not there is a nozzle that has ejection failure (S2106). If a nozzle having ejection failure is found, then checking is immediately interrupted, and nozzle cleaning is performed with respect to all of the nozzles #1 to #180 in all of the nozzle rows 211 that eject color ink (S2108). After finishing the nozzle cleaning, the procedure is returned to step S2102 again, the color-ink test pattern 2400 is formed again, and ejection testing is performed again with respect to the test pattern 2400 that has been formed.

On the other hand, if no nozzle having ejection failure is found, then checking is continued until checking of the patterns 2412 corresponding to each of the nozzles #1 to #180 of all of the nozzle rows 211 formed in the test pattern 2400 is completely finished (S2110).

After finishing inspection of the ejection of the color ink and ejection failure in the nozzles #1 to #180 of the color ink nozzle rows 211 is completely eliminated, then, the ejection of the clear ink is inspected. First, the clear-ink test pattern 2500 is formed (S2112). Then, the printer starts detecting the clear-ink test pattern 2500 that has been formed using the reflective optical sensor 300 provided on the carriage 41, in a similar way as for the color-ink test pattern 2400 (S2114), and it checks whether or not there is a nozzle that has ejection failure (S2116). If a nozzle having ejection failure is found, then checking is immediately interrupted, and nozzle cleaning is performed with respect to all of the nozzles #1 to #180 in the clear ink nozzle row 212 (S2108). It should be noted that in the present embodiment, nozzle cleaning is performed not only with respect to the nozzle row 211 including the nozzle with the ejection failure, but with respect to all of the nozzle rows 211.

On the other hand, if no nozzle having ejection failure is found, then checking is continued until checking of the patterns 2508 corresponding to each of the nozzles #1 to #180 of the clear ink nozzle row 212 formed in the test pattern 2050 is completely finished (S2110).

After eliminating any ejection failure in the nozzles #1 to #180 of the color ink nozzle rows 211 certainly in this way, the clear-ink test pattern 2500 is formed and the ejection of the clear ink is inspected. Therefore, it is possible to certainly form the clear-ink test pattern 2500 without being affected by whether or not there is ejection failure of the color ink, and thus, it becomes possible to inspect the ejection of the clear ink accurately.

It should be noted that when performing this testing procedure, it is preferable to form the color-ink test pattern 2400 and the clear-ink test pattern 2500 on the same medium S, because this is less burdensome and achieves conservation of the medium S.

Further, the nozzle cleaning does not have to be performed with respect to all of the nozzle rows 211, but it may be performed with respect to only the nozzle row 211 etc. that includes the nozzle with the ejection failure. Further, the nozzle cleaning may be performed with respect to only a portion in which the nozzle with the ejection failure is provided.

<Other Testing Procedures>

Figure 30:
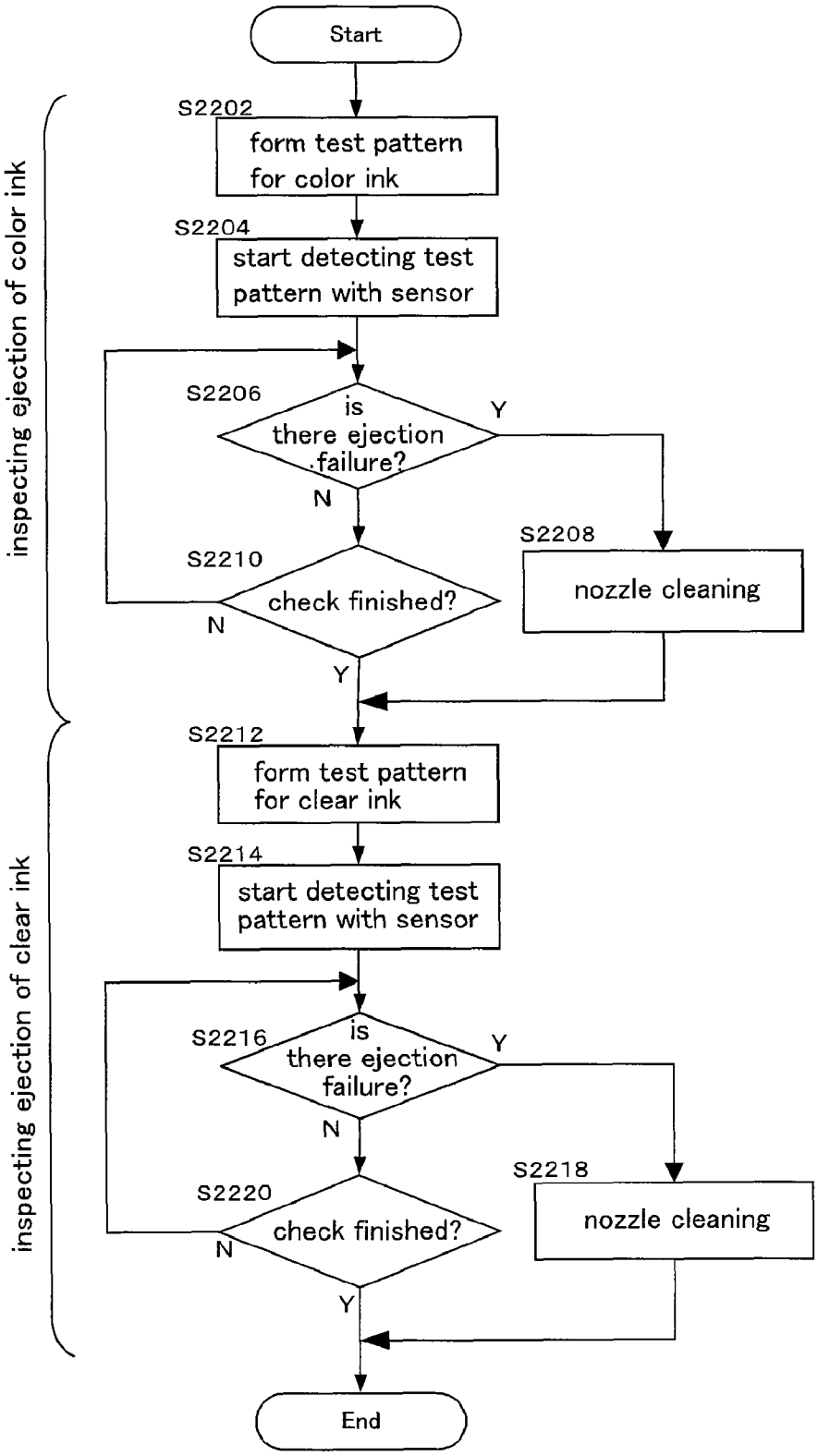
FIG. 30 is a flowchart showing another ejection testing procedure according to the second embodiment.

FIG. 30 shows an example of another testing procedure. Also in this example, the ejection of the color ink is inspected first, and then, the ejection of the clear ink is inspected afterwards, as shown in the figure. That is, the color-ink test pattern 2400 is formed first (S2202). Then, the printer starts detecting the color-ink test pattern 2400 that has been formed using the reflective optical sensor 300 provided on the carriage 41 (S2204). Then, based on the detection results, the printer checks whether or not there is a nozzle with an ejection failure (S2206). If a nozzle having an ejection failure is found, then checking is immediately interrupted, and nozzle cleaning is performed with respect to all of the nozzles #1 to #180 in all of the nozzle rows 211 that eject color ink (S2208). It should be noted that, as in the previous example, nozzle cleaning is performed not only with respect to the nozzle row 211 including the nozzle with the ejection failure, but with respect to all of the nozzle rows 211.

In the present embodiment, the procedure does not return to step S2202 after finishing the nozzle cleaning to form the color-ink test pattern 2400 again, as in the procedure shown in FIG. 29. Instead, the procedure proceeds to the inspection of the ejection of the clear ink. This is because it is possible to assume that the ejection failure in the nozzles #1 to #180 has been sufficiently eliminated by performing the nozzle cleaning with respect to the nozzles #1 to #180 of the color ink nozzle rows 211. In this way, it is possible to eliminate the burden of forming the color-ink test pattern 2400 again and performing re-inspection based on the test pattern 2400.

On the other hand, checking for any ejection failure is continued until checking of the patterns 2412 corresponding to each of the nozzles #1 to #180 of all of the nozzle rows 211 formed in the test pattern 2400 is completely finished (S2110).

Similarly, regarding inspection of the ejection of the clear ink, the clear-ink test pattern 2500 is formed (S2212), the detection of the test pattern 2500 using the reflective optical sensor 300 is started (S2214), whether or not there is a nozzle that has ejection failure is checked (S2216), and if a nozzle having ejection failure is found, then nozzle cleaning is performed (S2218). After finishing the nozzle cleaning, the process is ended.

It should be noted that checking for any ejection failure is continued until checking of the patterns 2508 corresponding to each of the clear-ink nozzles #1 to #180 formed in the test pattern 2500 is completely finished (S2110).

Further, also in this example, the nozzle cleaning does not have to be performed with respect to all of the nozzle rows 211, but it may be performed with respect to only the nozzle row 211 etc. that includes the nozzle with the ejection failure. Further, the nozzle cleaning may be performed with respect to only a portion in which the nozzle with the ejection failure is provided.

===Method for Checking Test Patterns===

The following is a description of a method for checking the test patterns 2400 and 2500. Checking of the test patterns 2400 and 2500 is carried out using the reflective optical sensor 300 provided on the carriage 41. The reflective optical sensor 300 is arranged above the test patterns 2400 and 2500 and checks the block-shaped patterns 2412 and 2508 formed in the test patterns 2400 and 2500 line by line by moving relative to the medium S with the movement of the carriage 41. At this time, light is emitted toward the medium S from the light-emitting section 300A of the reflective optical sensor 300, and the emitted light is reflected by the medium S and received by the light-receiving section 300B. The reflective optical sensor 300 outputs the amount of light received by the light-receiving section 300B to the system controller 126.

Based on the result of light received from the reflective optical sensor 300, the system controller 126 checks the nozzles individually for whether or not there is an ejection failure. Specifically, the system controller 126 compares the amount of light received by the light-receiving section 300B of the reflective optical sensor 300 with a predetermined threshold value that is stored in advance in the main memory 127 etc., and determines whether or not there is an ejection failure. When one line of the checking is finished, the medium is carried by the carrying section and checking with respect to the next line is carried out. In this way, whether or not there is an ejection failure is checked successively using the test patterns 2400 and 2500.

===Nozzle Cleaning===

Below are types of nozzle cleaning carried out when it is determined, as a result of testing ejection, that there is ejection failure in a nozzle.

<Nozzle Suction>

This is a method carried out using the cleaning unit 30 described in FIG. 2. Specifically, ink is forcefully sucked out from the nozzles #1 to #180 of each of the nozzle rows 211 and 212 by the above-described pump device 31 to eliminate the clogging or other ejection failure.

<Flushing>

Flushing is a method by which ink is forcefully ejected from the nozzles #1 to #180. Specifically, the piezo elements of the nozzles #1 to #180 are driven to forcefully discharge ink from the nozzles. This eliminates the clogging or other ejection failure.

It should be noted that as regards "nozzle suction" and "flushing", it is preferable for the suction force of the pump device 31 or the ink ejection amount to be appropriately changeable, such as in a stepwise manner. In this way, it is possible to smoothly eliminate ejection failure in a nozzle by changing the suction force of the pump device 31 or the ink ejection amount in accordance with how much the ejection failure in the nozzle has been eliminated. Specifically, for example, if clogging etc. of a nozzle is not eliminated in a single nozzle cleaning process, then it is possible to perform such operation as to eliminate the ejection failure by carrying out an even intense nozzle cleaning. By doing so, it is possible to reduce, as much as possible, the amount of ink discarded upon nozzle cleaning.

As described above, according to the present embodiment, it is possible to easily determine whether or not the clear ink is being ejected properly because, by ejecting the clear ink and the color ink in an overlapped manner, the color becomes different from that for when only the color ink is ejected. Further, since the color-ink test pattern 2400 is formed first to inspect the ejection of the color ink first and then the clear-ink test pattern 2500 is formed to inspect the ejection of the clear ink, the clear ink overlaps the color ink certainly, and thus, it becomes possible to inspect the ejection of the clear ink accurately.

It should be noted that in the foregoing embodiment, a single pattern including test patterns for all of the color inks was formed as the color-ink test pattern 2400 (first test pattern), and ejection testing was performed based on that pattern. The present invention, however, is not limited to this, and the test patterns may be formed separately for each color, and the ejection testing may be performed separately.

Further, in the foregoing embodiment, a pattern in which the test patterns for each nozzle were formed spaced apart from each other was used as the clear-ink test pattern 2500 (second test pattern), but patterns of other forms may be used as well.

===Configuration of the Printing System Etc.===

The following is a description of an example of a printing system provided with an inkjet printer, which serves as a printing apparatus, as an example of a printing system according to the present invention.

Figure 31:
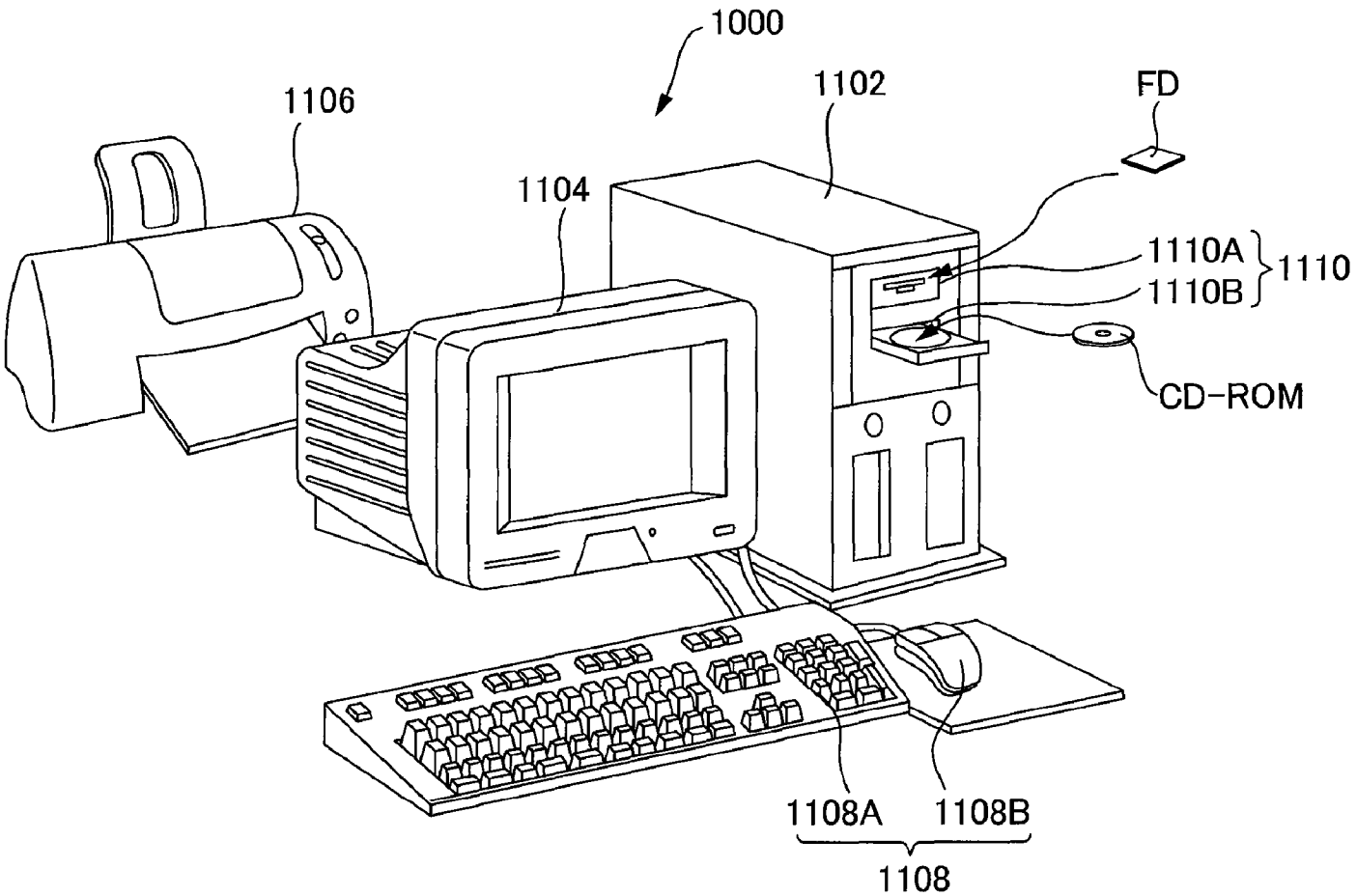
FIG. 31 is a diagram showing the external configuration of a printing system.

FIG. 31 is an explanatory diagram showing the external configuration of the printing system. A printing system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 32:
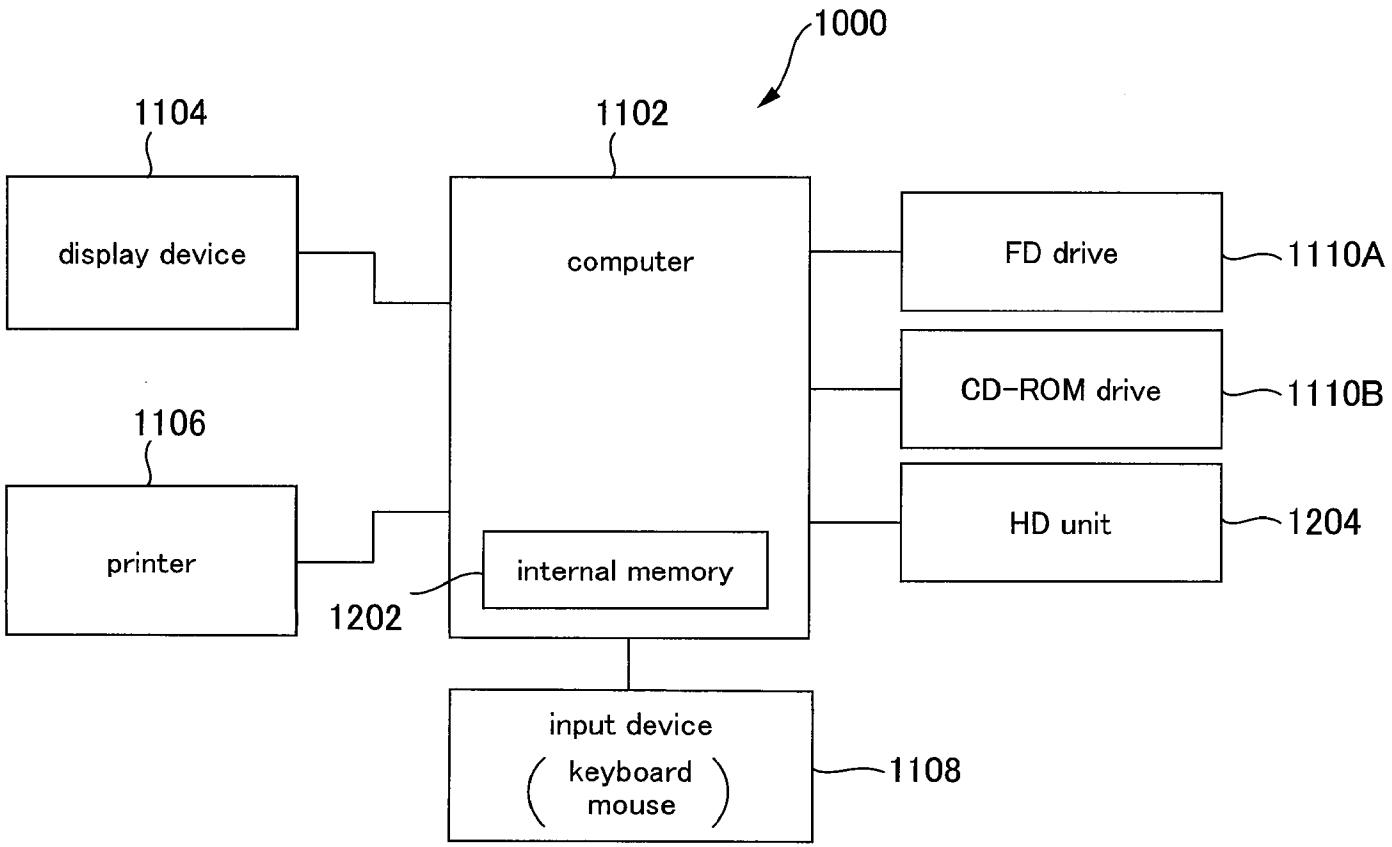
FIG. 32 is a block diagram showing the configuration of the printing system.

FIG. 32 is a block diagram showing the configuration of the printing system shown in FIG. 31. An internal memory 1202 such as a RAM within the housing accommodating the main computer unit 1102 and, also, an external memory such as a hard disk drive unit 1204 are provided.

A computer program for controlling the operation of the above printer can be downloaded onto the computer 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read by various types of reading devices 1110.

In the above description, an example was described in which the computer system is constituted by connecting the printer 1106 to the main computer unit 1102, the display device 1104, the input device 1108, and the reading device 1110. However, this is not a limitation. For example, the computer system can be made of the main computer unit 1102 and the printer 1106, or the computer system does not have to be provided with one of the display device 1104, the input device 1108, and the reading device 1110. It is also possible for the printer 1106, for example, to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be incorporated in a memory, which is a storage medium of the control unit. Also, the control unit may execute the computer program stored in the memory so as to achieve the operations of the printer in the embodiment described above.

As an overall system, the printing system that is thus achieved becomes superior to conventional systems.

Other Embodiments

In the foregoing, a printing apparatus such as a printer according to the invention was described based on an embodiment thereof. However, the foregoing embodiment is for the purpose of elucidating the present invention and is not to be interpreted as limiting the present invention. The invention can of course be altered and improved without departing from the gist thereof and includes its equivalents. In particular, the embodiments mentioned below are also included in the printing apparatus according to the present invention.

Furthermore, in the present embodiment, all or part of the configuration realized by hardware may be replaced by software. Conversely, parts of the configuration realized by software may be replaced by hardware.

Furthermore, in addition to printing paper, the medium to be printed may be cloth or film, for example.

Furthermore, part of the processes carried out on the printing apparatus side may be carried out on the host side, and it is also possible to interpose a special-purpose processing device between the printing apparatus and the host such that some of the processes are carried out by the processing device.

<Regarding the Printing Apparatus>

The printing apparatus according to the present invention is not limited to the above-described inkjet printer, and may be a printing apparatus that carries out printing using a different method of ink ejection, such as a bubble-jet (registered trademark) type printer.

<Regarding the Color-Ink Nozzle>

In the foregoing embodiment, a nozzle row in which a multitude of nozzles are arranged in a straight line as described above was given as an example of the color-ink nozzle, but the present invention is not limited to such a nozzle row, and the color-ink nozzle may be arranged in any form as long as it is a nozzle that ejects color ink.

<Regarding the Clear-Ink Nozzle>

In the foregoing embodiment, a nozzle row in which a multitude of nozzles are arranged in a straight line as described above was given as an example of the clear-ink nozzle, but the present invention is not limited to such a nozzle row, and the clear-ink nozzle may be arranged in any form as long as it is a nozzle that ejects clear ink.

<Regarding the Medium S>

Regarding the medium S, it is possible to use plain paper, matte paper, cut paper, glossy paper, roll paper, print paper, photo paper, and roll-type photo paper or the like as the above-described print paper, and in addition to these, the medium may be a film material such as OHP film and glossy film, a cloth material, or a metal plate material or the like. In other words, it may be any kind of media as long as it is capable of being an object for the ejection of a liquid.

<Regarding the Sensor>

In the foregoing embodiment, a reflective optical sensor 300 was provided as a sensor for detecting the test pattern, but the present invention is not limited to this, and various types of sensors employing other systems, such as optical sensors of the type other than the reflective type, may be provided as long as they are able to detect the test pattern.

Further, in the foregoing embodiment, the sensor 300 (reflective optical sensor) was provided on the carriage 41, but the present invention is not limited to this, and the sensor may be provided in/on places other than the carriage 41.

<Testing Method>

In the foregoing embodiment, the test patterns of both the clear ink and the color ink were detected using the sensor 300 (reflective optical sensor) installed in the printing apparatus and inspection was automatically performed by the printing apparatus, but the present invention is not limited to this, and the test patterns may be checked using other inspection devices etc., or they may be checked by a person.

What is claimed is:

1. A method for forming an ejection-test pattern for a clear ink, the method comprising:

ejecting a clear ink toward a medium from a particular clear-ink nozzle to form an ejection-test pattern;

ejecting a particular color ink, from a first color-ink nozzle, onto said clear ink ejected from said particular clear-ink nozzle to form said ejection-test pattern; and ejecting said particular color ink from a second color-ink nozzle onto said clear ink ejected from said particular clear-ink nozzle to form said ejection-test pattern, wherein a first region where said particular color ink ejected from said first color-ink nozzle is overlaid onto said clear ink ejected from said particular clear-ink nozzle is different from a second region where said particular color ink ejected from said second color-ink nozzle is overlaid onto said clear ink from said particular clear-ink nozzle.

2. A method for forming an ejection-test pattern according to claim 1, wherein said ejection-test pattern includes patterns for each of a plurality of particular clear-ink nozzles.

3. A method for forming an ejection-test pattern according to claim 1, wherein said ejection-test pattern is formed using one type of color-ink nozzles from among a plurality of types of color-ink nozzles that respectively eject color inks of different colors.

4. A method for forming an ejection-test pattern according to claim 3, wherein said ejection-test pattern is formed using one type of color-ink nozzles that ejects a color ink, among said color inks of different colors, other than a color ink of the lightest color.

5. A method for forming an ejection-test pattern according to claim 1, wherein said particular color ink and said clear ink blur when said particular color ink adheres to a region in which said clear ink has adhered.

6. A method for forming an ejection-test pattern according to claim 1, wherein a darkness of the color of said particular color ink when said particular color ink adheres to a region in which said clear ink has adhered is different from a darkness of the color of said particular color ink when said particular color ink adheres to a region in which said clear ink has not adhered.

7. A method for forming an ejection-test pattern according to claim 6, wherein a darkness of the color of said particular color ink when said particular color ink adheres to the region in which said clear ink has adhered is darker than a darkness of the color of said particular color ink when said particular color ink adheres to the region in which said clear ink has not adhered.

8. A method for forming an ejection-test pattern according to claim 1, wherein said particular color ink is also ejected from said first and second color-ink nozzles onto a region in which said clear ink should not be adhering.

9. A method for forming an ejection-test pattern according to claim 1, wherein an ejection-test pattern that is used for inspecting ejection of said first and second color-ink nozzles may be formed on the medium.

10. A method for forming an ejection-test pattern according to claim 9, wherein said ejection-test pattern that is used for inspecting ejection of said first and second color-ink nozzles is formed on the same medium as said ejection-test pattern that is used for inspecting ejection of said clear-ink nozzle.

11. A method for forming an ejection-test pattern for a clear ink, the method comprising:

ejecting a clear ink toward a medium from a particular clear-ink nozzle to form an ejection-test pattern;

after the clear ink is ejected from said particular clear-ink nozzle, ejecting, from a first color-ink nozzle, a particular color ink onto said clear-ink ejected from said particular clear-ink nozzle, to thereby form said ejection-test pattern; and ejecting said particular color ink from a second color-ink nozzle onto said clear ink ejected from said particular clear-ink nozzle to form said ejection-test pattern, wherein said ejection-test pattern includes patterns for each of a plurality of particular clear-ink nozzles;

wherein said ejection-test pattern is formed using one type of color-ink nozzles that ejects a color ink, among color inks of different colors, other than a color ink of the lightest color;

wherein said particular color ink and said clear ink blur when said particular color ink adheres to a region in which said clear ink has adhered;

wherein a darkness of the color of said particular color ink when said particular color ink adheres to the region in which said clear ink has adhered is darker than a darkness of the color of said particular color ink when said particular color ink adheres to a region in which said clear ink has not adhered;

wherein said particular color ink is also ejected from said first and second color-ink nozzles onto a region in which said clear ink should not be adhering; and wherein a first region where said particular color ink ejected from said first color-ink nozzle is overlaid onto said clear ink ejected from said particular clear-ink nozzle is different from a second region where said particular color ink ejected from said second color-ink nozzle is overlaid onto said clear ink from said particular clear-ink nozzle.

12. A printing apparatus comprising:

a particular clear-ink nozzle for ejecting a clear ink;

first and second color-ink nozzles for ejecting a particular color ink; and a controller for controlling ejection of ink from said particular clear-ink nozzle and said first and second color-ink nozzles;

wherein said controller:

causes said particular clear-ink nozzle to eject the clear ink toward a medium to form an ejection-test pattern;

causes said first color-ink nozzle to eject the particular color ink onto said clear ink ejected from said particular clear-ink nozzle to form said ejection-test pattern; and causes said second color-ink nozzle to eject said particular color ink onto said clear ink ejected from said particular clear-ink nozzle to form said ejection-test pattern;

wherein a first region where said particular color ink ejected from said first color-ink nozzle is overlaid onto said clear ink ejected from said particular clear-ink nozzle is different from a second region where said particular color ink ejected from said second color-ink nozzle is overlaid onto said clear ink from said particular clear-ink nozzle.

13. A non-transitory computer-readable storage medium storing codes executable by a computer, the codes comprising:

a code for causing a particular clear-ink nozzle to eject a clear ink toward a medium to form an ejection-test pattern;

a code for causing a first color-ink nozzle to eject a particular color ink onto said clear ink ejected from said particular clear-ink nozzle to form said ejection-test pattern; and a code for causing a second color-ink nozzle to eject said particular color ink onto said clear ink ejected from said particular clear-ink nozzle to form said ejection-test pattern wherein a first region where said particular color ink ejected from said first color-ink nozzle is overlaid onto said clear ink ejected from said particular clear-ink nozzle is different from a second region where said particular color ink ejected from said second color-ink nozzle is overlaid onto said clear ink from said particular clear-ink nozzle.

14. A printing system comprising:

a computer; and a printing apparatus that is connectable to said computer, said printing apparatus including:

a particular clear-ink nozzle for ejecting a clear ink;

first and second color-ink nozzles for ejecting a particular color ink; and a controller for controlling ejection of ink from said particular clear-ink nozzle and said first and second color-ink nozzles;

wherein said controller:

causes said particular clear-ink nozzle to eject the clear ink toward a medium to form an ejection-test pattern;

causes said first color-ink nozzle to eject the particular color ink onto said clear ink ejected from said particular clear-ink nozzle to form said ejection-test pattern; and causes said second color-ink nozzle to eject said particular color ink onto said clear ink ejected from said particular clear-ink nozzle to form said ejection-test pattern wherein a first region where said particular color ink ejected from said first color-ink nozzle is overlaid onto said clear ink ejected from said second color-ink nozzle is overlaid onto said clear ink from said particular clear-ink nozzle.

* * * * *